US009376908B2

(12) United States Patent
Ludwig et al.

(10) Patent No.: US 9,376,908 B2
(45) Date of Patent: Jun. 28, 2016

(54) PIPE CONVEYED EXTENDABLE WELL LOGGING TOOL

(75) Inventors: Wesley Neil Ludwig, Fort Worth, TX (US); John Hudson Hales, Frisco, TX (US); Flint R. George, Carrollton, TX (US); Ronald E. Cherry, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1103 days.

(21) Appl. No.: 13/498,852

(22) PCT Filed: Sep. 28, 2009

(86) PCT No.: PCT/US2009/058609

§ 371 (c)(1),
(2), (4) Date: Jun. 5, 2012

(87) PCT Pub. No.: WO2011/037588

PCT Pub. Date: Mar. 31, 2011

(65) Prior Publication Data

US 2012/0241172 A1 Sep. 27, 2012

(51) Int. Cl.
*E21B 47/017* (2012.01)
*E21B 47/01* (2012.01)

(52) U.S. Cl.
CPC ..... *E21B 47/01* (2013.01); *E21B 47/011* (2013.01)

(58) Field of Classification Search
CPC ..... E21B 47/01; E21B 47/12; E21B 47/013; E21B 47/017
USPC ..... 166/254.2
See application file for complete search history.

(56) References Cited

U.S. PATENT DOCUMENTS

| | | | | |
|---|---|---|---|---|
| 2,913,005 | A * | 11/1959 | Grant | F15B 13/0431 137/625.6 |
| 3,832,851 | A * | 9/1974 | Kiernan | 60/563 |
| 4,434,704 | A * | 3/1984 | Surjaatmadja | F15B 11/121 137/624.2 |
| 4,664,189 | A * | 5/1987 | Wittrisch | 166/250.17 |
| 4,715,446 | A * | 12/1987 | Wittrisch | E21B 17/10 166/381 |
| 5,217,075 | A | 6/1993 | Wittrisch | |
| 6,179,055 | B1 * | 1/2001 | Sallwasser et al. | 166/254.2 |
| 6,419,013 | B1 * | 7/2002 | Milne et al. | 166/254.2 |
| 2002/0112859 | A1 | 8/2002 | Bloom et al. | |
| 2005/0029017 | A1 | 2/2005 | Berkheimer et al. | |
| 2008/0202767 | A1 | 8/2008 | Sheiretov et al. | |
| 2009/0194270 | A1 | 8/2009 | Bissonnette et al. | |

OTHER PUBLICATIONS

International Search Report and Written Opinion of PCT Application No. PCT/US2009/058609 (1391-87300) dated May 13, 2010: pp. 1-9.

* cited by examiner

*Primary Examiner* — William P Neuder
*Assistant Examiner* — Ronald Runyan
(74) *Attorney, Agent, or Firm* — Chamberlain Hrdlicka

(57) ABSTRACT

A pipe conveyed extendable well logging assembly includes a deployment system for extending and retracting a well logging tool relative to the pipe while downhole. The logging tool may be releasably latched to the pipe, and may include position sensors for position feedback and depth correction.

29 Claims, 25 Drawing Sheets

PIPE CONVEYED EXTENDABLE WELL LOGGING TOOL

This application is the U.S. National Stage under 35 U.S.C. 371 of International Patent Application No. PCT/US2009/058609 filed Sep. 28, 2009, entitled "Pipe Conveyed Extendable Well Logging Tool."

BACKGROUND

During the drilling and completion of oil and gas wells, it may be necessary to engage in ancillary operations, such as evaluating the production capabilities of formations intersected by the well bore. For example, after a well or well interval has been drilled, zones of interest are often measured or tested to determine various formation and fluid properties. These tests are performed in order to determine whether commercial exploitation of the intersected formations is viable and how to optimize production. The acquisition of accurate data from the well bore is critical to the optimization of hydrocarbon wells. This well bore data can be used to determine the location and quality of hydrocarbon reserves, whether the reserves can be produced through the well bore, and for well control during drilling operations.

The collected data is contained in a survey or "log," then analyzed to determine one or more properties of the formation, sometimes as a function of depth. Many types of formation evaluation logs, e.g., mechanical, resistivity, acoustic and nuclear, are recorded by appropriate downhole instruments supported by a housing. The housing may include a sonde with the instruments and a cartridge with associated electronics to operate the instruments in the sonde. Such a logging tool is lowered into the well bore to measure properties of the formation. To reduce logging time, a combination of logging tools may be lowered in a single logging run.

Often, logging tools are lowered into vertical well bores by wireline. Gravity moves the logging tools into the well bore, and the wireline is used for electrical communication and support for pulling the logging tools out of the well bore. Logging deep, extended, deviated or horizontal wells can be problematic with wireline. The wireline provides no driving force for pushing, rather than pulling, logging tools further into the well bore. To log such well bores, tubulars such as coiled tubing or drill pipe transport logging tools into the well bore. Pipe, tubing, tubular and like terms may all be used to reference such a conveyance. In some cases, wireline logging tools are adapted for drill pipe deployment. The logging tools are coupled to the operational end of the tubular and may be extendable from the tubular.

Pipe conveyed well logging tools are relatively fragile as compared to the drill string from which they are deployed. Further, extendable well logging tools are exposed to the downhole environment. When a borehole is drilled, it is seldom smooth and regular. It has cave-ins, erosions, washouts, shales and clays that squeeze into the hole, ledges, protrusions and other rugosity. The drill string can impart large forces to the logging tools, easily capable of damaging any deployed arms or even the main body of the logging tools themselves. Since some tools can be damaged with compression forces on the order of 10,000 lbs., the tools are very susceptible to much greater forces produced by a drill string. When the tools are extended and latched into the bottom of the drill string, the downward motion of the pipe can be transmitted directly to the logging tools. If the bottom of the logging tools are forced into a washout or against a ledge, a substantial force can be transmitted to the tools by the drill string. Upward forces on the logging tools, as well as obtrusive debris in the well bore, can also cause unwanted adjustments of the expected distance between the extended logging tool and the drill pipe, thereby affecting the accuracy of the depth-dependent measurements and formation properties derived therefrom. In some cases, pipe conveyed logging tools do not have communication to the surface and cannot be directly controlled (e.g., powered up, motored open and closed, etc.) from the surface as is customary for purely wireline tools.

These and other limitations of the prior art are overcome by the embodiments, arrangements and processes as taught herein.

BRIEF DESCRIPTION OF THE DRAWINGS

For a detailed description of exemplary embodiments of the invention, reference will now be made to the accompanying drawings in which.

DETAILED DESCRIPTION

Figure 1:
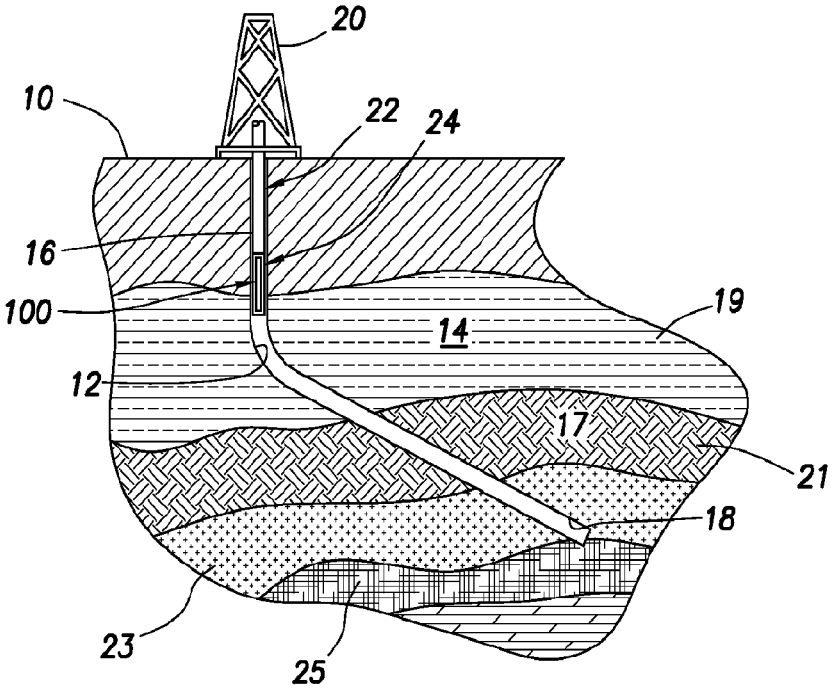
FIG. 1 is a schematic view, partly in cross-section, of an operational environment for a pipe conveyed extendable well logging apparatus in accordance with principles disclosed herein.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a well bore 12 has been drilled into a formation 14, and includes an upper substantially vertical portion 16 and a lower deviated or horizontal portion 17 with a terminal end 18. The formation 14 also includes different layers 19, 21, 23, 25 possibly representing well zones of interest. Surface equipment 20 at a surface 10 overlays the borehole 12 and couples to and operates a tubular conveyance 22. As previously described, the tubular conveyance 22 may also be referred to as drill pipe, coiled tubing or other downhole tubulars. The drill pipe 22 includes a garage 24 at its lower end. The garage 24 contains extendable and retractable logging tool assembly 100. In some embodiments, the logging tool 100 includes multiple logging devices. The drill pipe 22 conveys the logging tool assembly 100, fully retracted inside the garage 24, into the vertical well portion 16.

Though embodiments of the logging tool assembly 100 will described throughout the present disclosure, an exemplary embodiment of the logging tool 100 includes a battery operated logging tool string that records data in memory. Logging data is collected and stored into the memory as the drill pipe is tripped out of the well.

Figure 2:
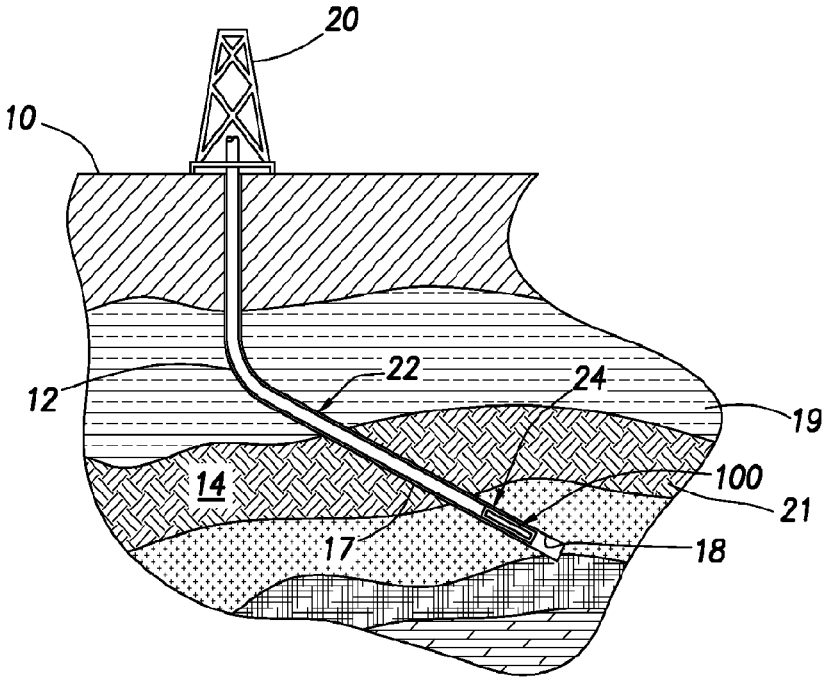
FIG. 2 is the pipe conveyed extendable well logging apparatus of FIG. 1 positioned below a well zone of interest.

Referring next to FIG. 2, the surface equipment 20 continues to operate to convey the drill pipe 22 and the logging tool assembly 100 further into the well bore 12. Specifically, the drill pipe 22 is moved into the deviated or horizontal well portion 17 such that the logging tool assembly 100 is directed toward the well bore end 18. The logging tools 100 remain retracted in the garage 24 for protection and to maintain a power down state to preserve stored operational energy, e.g., battery power. The logging tools 100 are conveyed to a location below a predetermined well bore zone of interest, for example the formation layer 21 and/or the formation layer 19.

Figure 3:
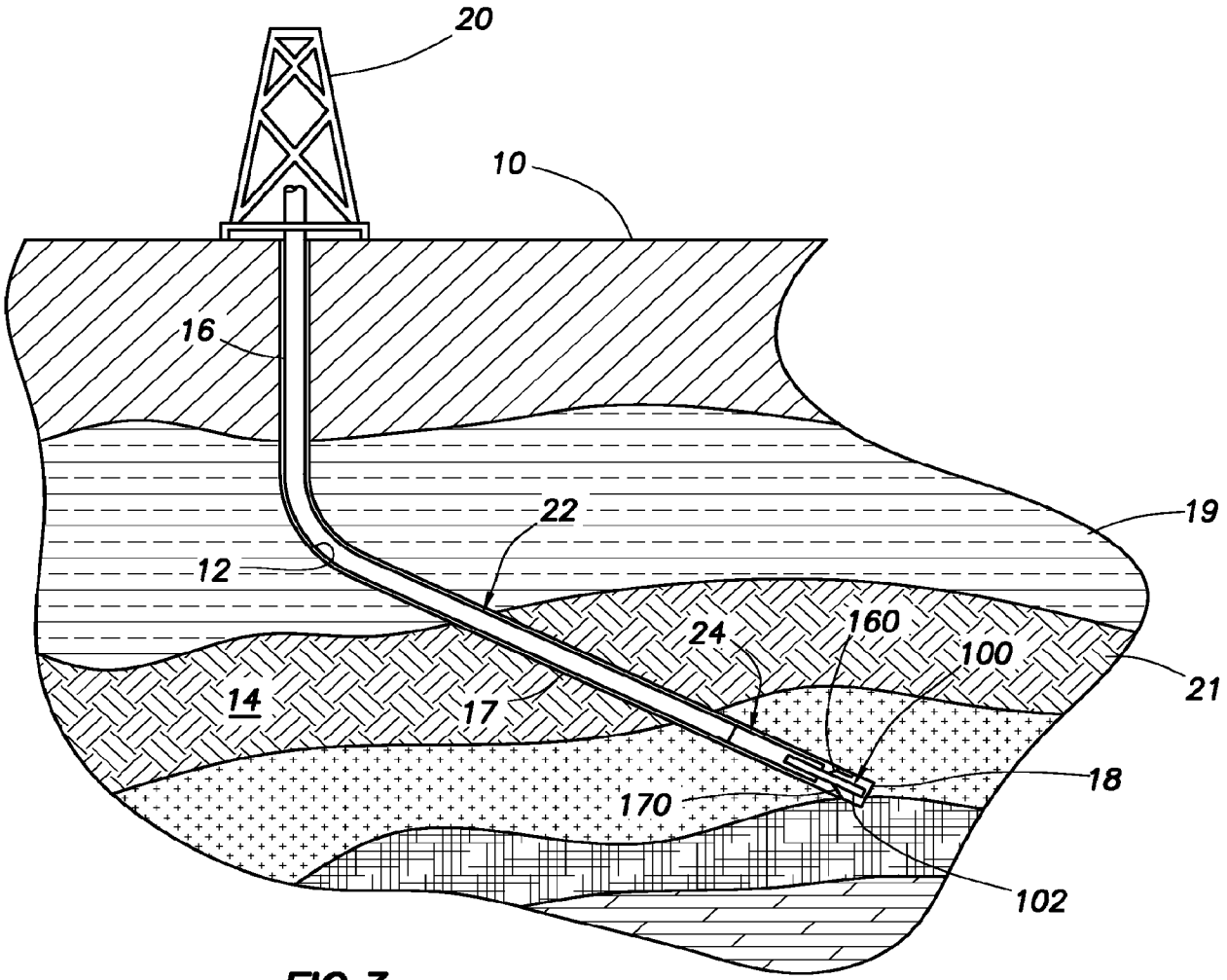
FIG. 3 is the pipe conveyed extendable well logging apparatus of FIGS. 1 and 2 in an extended and deployed position.

Referring now to FIG. 3, the logging tool assembly 100 is deployed from the garage 24. Deployment of the logging assembly 100 may include one or more of extending a tool body 102 axially out and away from the garage 24, powering up the tool assembly 100, radially extending logging devices 160, 170 from the tool body 102 via motors or other drive mechanisms, and communicating control signals and electronic data between and among the controllers, electronics, memory, sensors, and logging devices as more fully explained herein. A deployed and activated logging tool assembly 100 is now located below a well zone to be logged.

Figure 4:
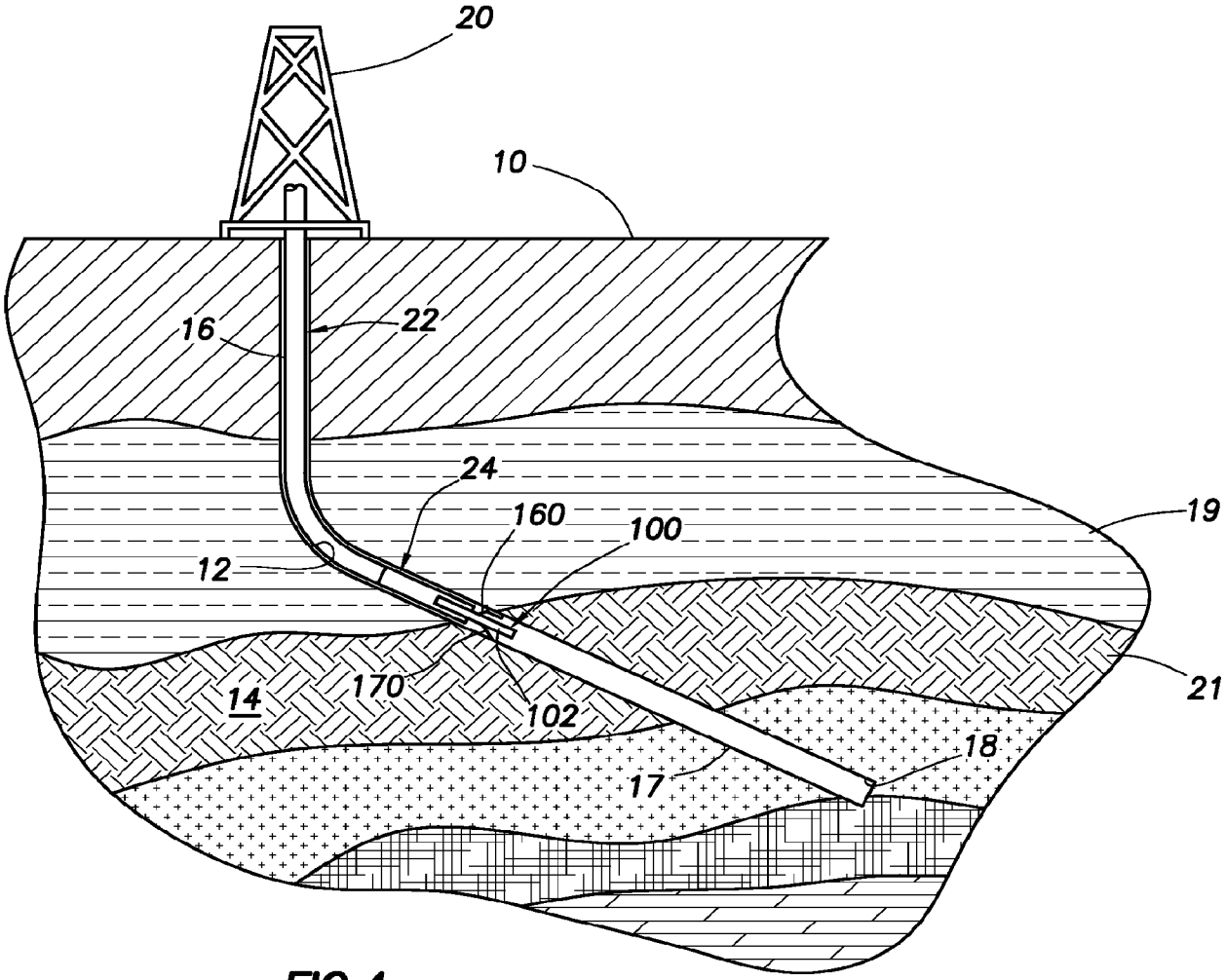
FIG. 4 is the pipe conveyed extendable well logging apparatus of FIGS. 1-3 being moved by the drill pipe through the well zone of interest for logging.
Figure 5:
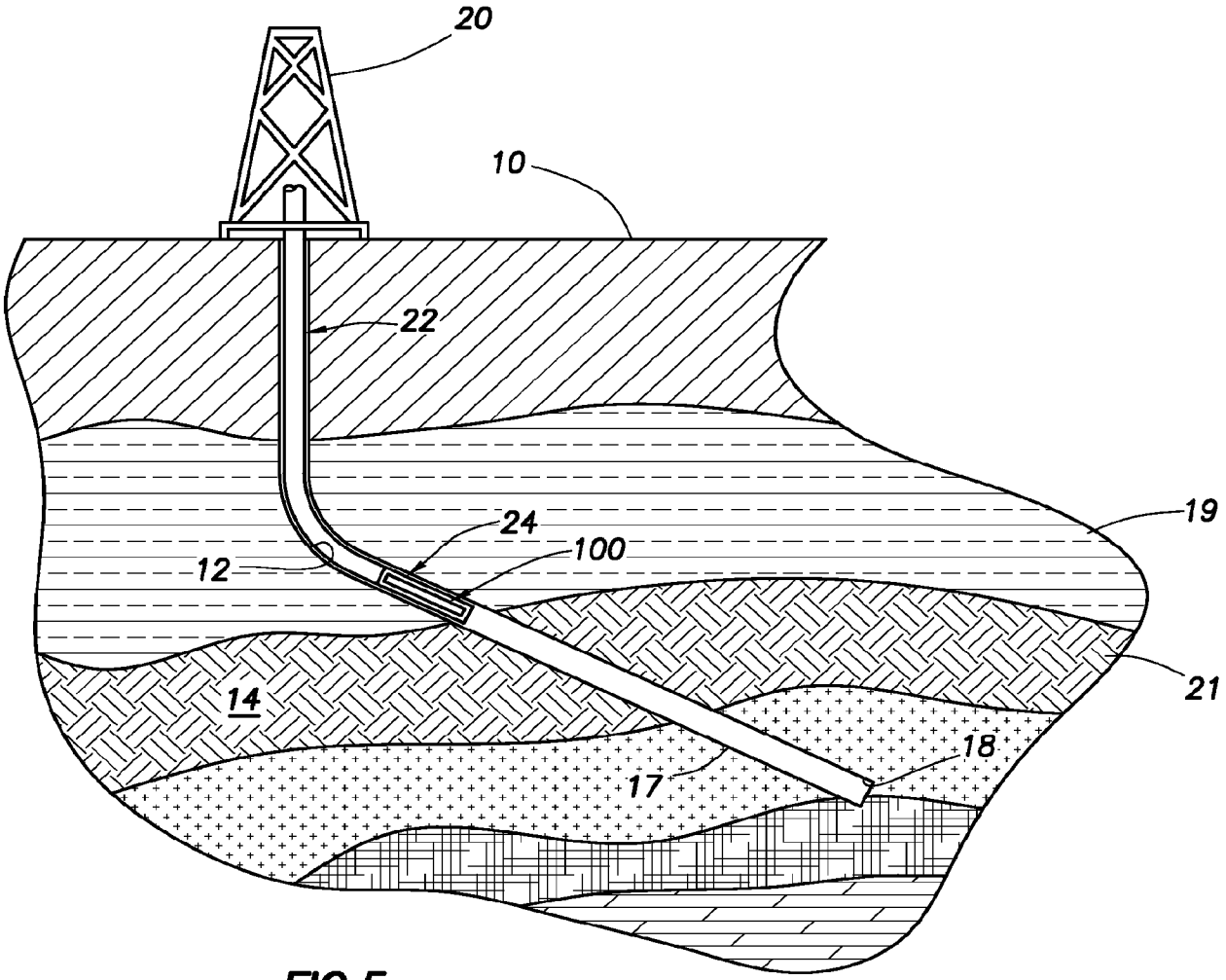
FIG. 5 is the pipe conveyed extendable well logging apparatus of FIGS. 1-4 in a retracted position after logging the well zone of interest.

Referring to FIG. 4, the surface equipment 20 is operated to pull the drill pipe 22 up through the borehole 12 and thereby move the logging assembly 100 through the zone of interest 21. The logging assembly 100 and the logging devices 160, 170 are operated to take measurements and record a log of the zone 21. In some embodiments, the logging assembly 100 is pulled further up the borehole 12 to log the formation zone 19 and any other zones of interest. In some embodiments, as shown in FIG. 5, the logging assembly 100 is retracted back into the garage 24 by radially retracting the logging devices 160, 170 and axially retracting the tool body 102 into the garage 24. Furthermore, the logging assembly 100 may be powered down to preserve battery power. In some embodiments, the retracted tool 100 as shown in FIG. 5 can be tripped out of the well bore 12 using the drill pipe 22. In other embodiments, the tool 100 can be re-deployed to execute a well logging repeat section of the formation zone 21, as will be more fully explained herein.

Figure 6:
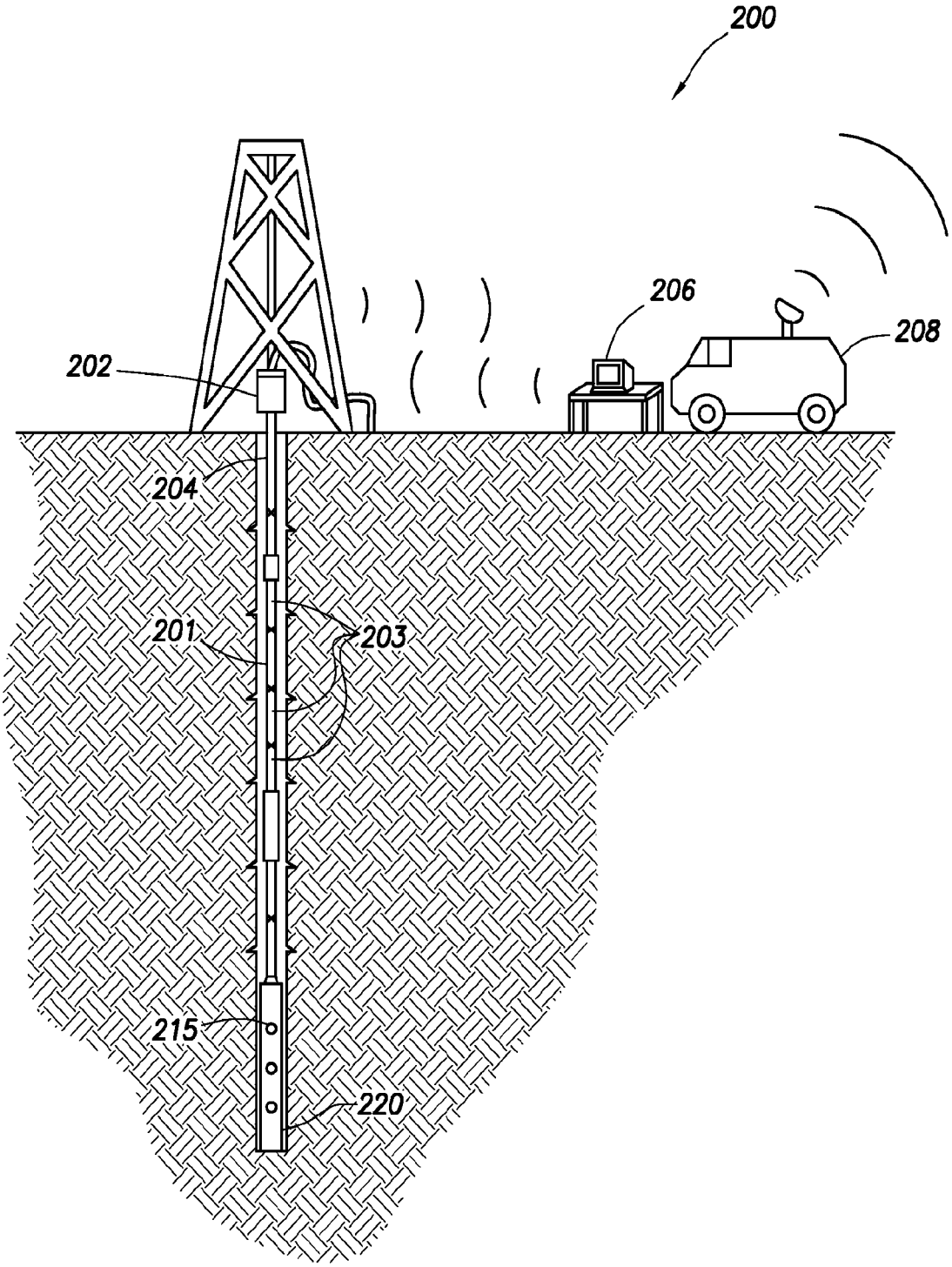
FIG. 6 is a schematic view, partly in cross-section, of a pipe conveyed logging tool disposed on a wired drill pipe coupled to a telemetry network.

Referring to FIG. 6, a telemetry network 200 is shown. A pipe conveyed logging tool 220 is coupled to a drill string 201 formed by a series of wired drill pipes 203 connected for communication across junctions using communication elements as described below. It will be appreciated that work string 201 can be other forms of conveyance, such as coiled tubing or wired coiled tubing. A top-hole repeater unit 202 is used to interface the network 200 with logging control operations and with the rest of the world. In one aspect, the repeater unit 202 is operably coupled with pipe control equipment 204 and transmits its information to the drill rig by any known means of coupling information to a fixed receiver. In another aspect, two communication elements can be used in a transition sub. A computer 206 in the rig control center can act as a server, controlling access to network 200 transmissions, sending control and command signals downhole, and receiving and processing information sent up-hole. The software running the server can control access to the network 200 and can communicate this information, in encoded format as desired, via dedicated land lines, satellite link (through an uplink such as that shown at 208), Internet, or other means to a central server accessible from anywhere in the world. The logging tool 220 is shown linked into the network 200 for communication of data gathered by logging devices and sensors 215 along its conductor path and along the wired drill string 201. The telemetry network 200 may combine multiple signal conveyance formats (e.g., mud pulse, fiber-optics, acoustic, EM hops, etc.). It will also be appreciated that software/firmware may be configured into the tool 220 and/or the network 200 (e.g., at surface, downhole, in combination, and/or remotely via wireless links tied to the network).

Figure 7:
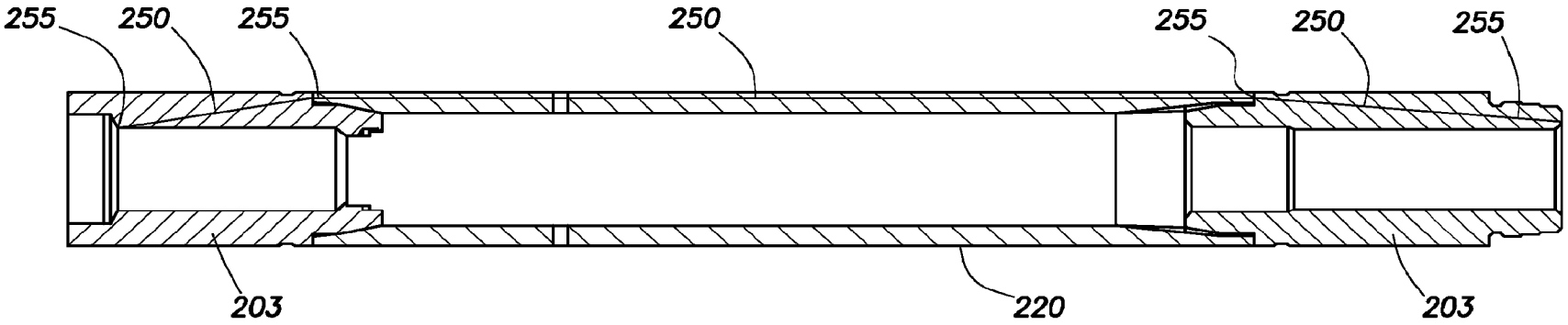
FIG. 7 is a cross-section view of a section of wired drill pipe.

Referring to FIG. 7, a section of the wired drill string 101 is shown including the tubular tool body 220. Conductors 250 traverse the entire length of the tubular body 220. Portions of wired drill pipes 203 may be subs or other connections means. In some embodiments, the conductor(s) 250 comprise coaxial cables, copper wires, optical fiber cables, triaxial cables, and twisted pairs of wire. The ends of the wired subs 203 are configured to communicate within a downhole network as described herein.

Communication elements 255 allow the transfer of power and/or data between the sub connections and through the tubular 220. The communication elements 255 may comprise inductive couplers, direct electrical contacts, optical couplers, and combinations thereof. The conductor 250 may be disposed through a hole formed in the walls of the outer tubular members of the body 220 and pipes 203. In some embodiments, the conductor 250 may be disposed part way within the walls and part way through the inside bore of the tubular members or drill pipes. In some embodiments, a coating may be applied to secure the conductor 250 in place. In this way, the conductor 250 will not affect the operation of the tool 220. The coating should have good adhesion to both the metal of the pipe and any insulating material surrounding the conductor 250. Useable coatings 312 include, for example, a polymeric material selected from the group consisting of natural or synthetic rubbers, epoxies, or urethanes. Conductors 250 may be disposed on the subs using any suitable means.

Figure 8:
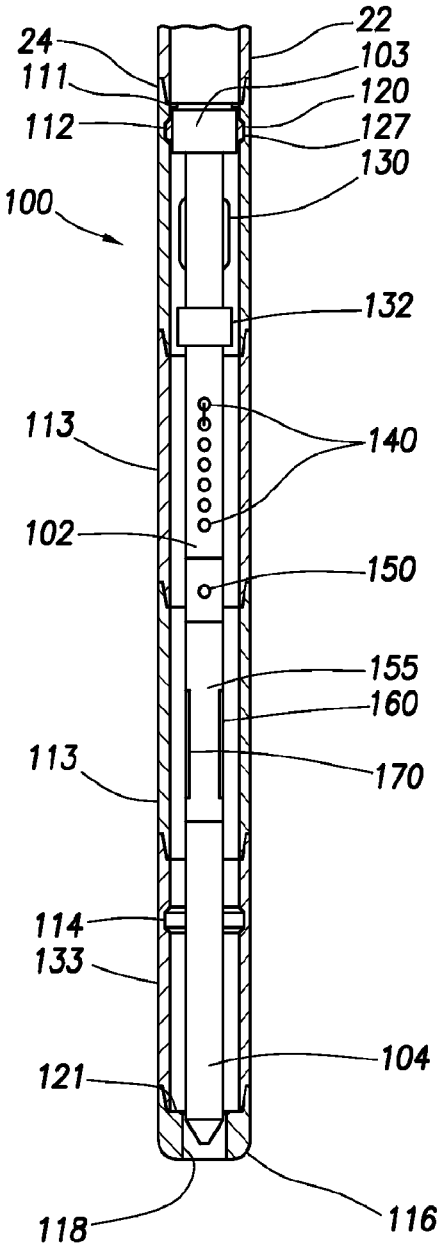
FIGS. 8-16 are partial cross-section views showing the well logging and garage assembly of FIGS. 1-5 in greater detail to illustrate various retracted, extended, and partially extended positions of the well logging assembly relative to the garage.

Referring now to FIG. 8, an enlarged view of the logging assembly 100 is shown. The drill pipe 22 couples to the garage 24, which are cut away to reveal the logging tool body 102 retracted within the garage 24. In some embodiments, the garage 24 comprises extension segments 113. An upper end 103 of the tool body 102 includes a releasable latch 120 including retractable and extendable latch members 127 that connect into an upper latch profile 112 of the garage 24 when the tool body 102 is in the retracted and stored position as shown. Disposed above the upper latch profile 112 is an upper stop ring 111 for axially retaining the tool body 102 in the garage 24. Below the latch 120 is a tractor 130 and a stop collar 132. Below the stop collar 132 is a position sensor or sensor array 140. Below the position sensor array 140 is an emergency sensor or sensor array 150. Below the sensor 150 is a logging device sub 155 including an extendable sensor pad 160 and an extendable back up arm 170. The lower end 104 of the tool body 102 may contain other features of the logging tool 100, including electronics. A lower extension segment 133 includes a lower latch profile 114 and a lower end 116 having a lower stop ring 121 and an opening or throughbore 118 for receiving the logging tool body 102.

The position sensors 140 operate to identify the position of the tool body 102 relative to the garage 24, and therefore the drill pipe 22. In some embodiments, the sensors 140 are a series of point sensors that can detect the presence or absence of steel surrounding their position. In exemplary embodiments, the sensors 140 are part of a detection system that detects the presence or absence of a magnet or magnets placed at strategic locations in the drill string and garage conveyance. In other embodiments, the sensors 140 are a series of mechanical switches activated by corresponding features in the drill string and garage conveyance and deployment system. In further embodiments, the sensor 140 is a long stroke linear sensor. In some embodiments, the sensors 140 reside in a battery sub. In other embodiments, the sensors 140 reside in other subs arranged at various location in the tool body 102.

Figure 9:
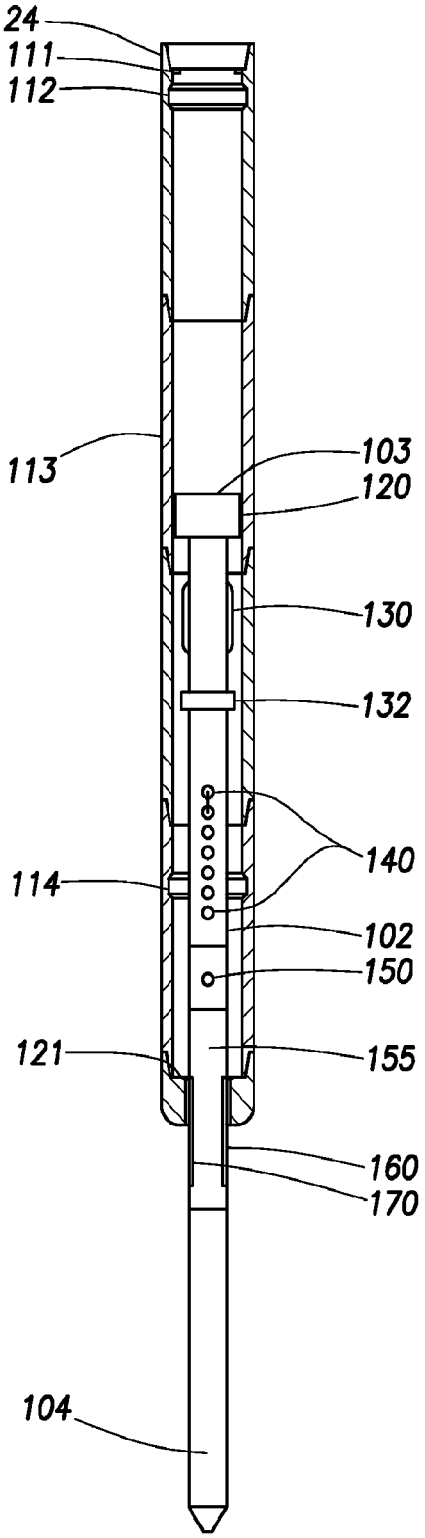
Figure 10:
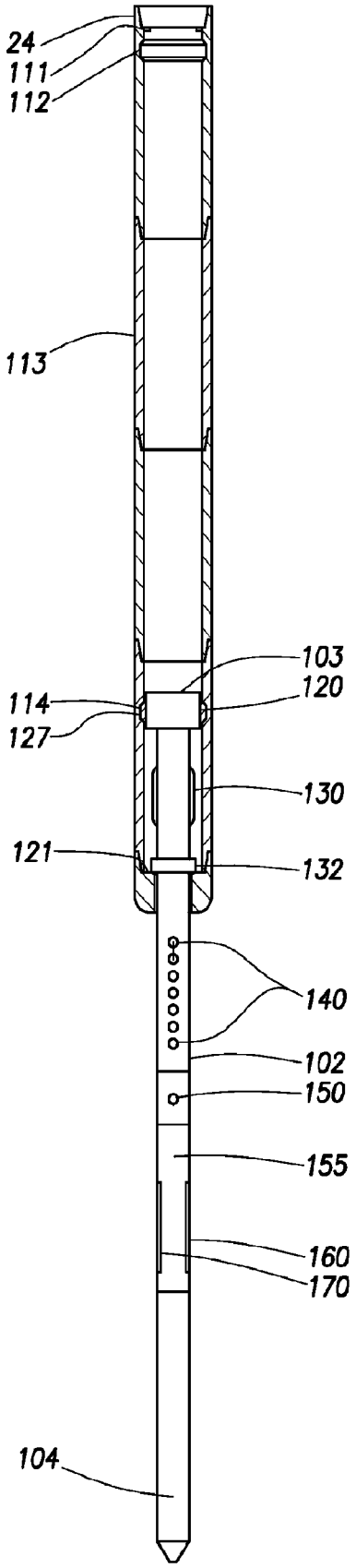

Referring next to FIG. 9, the logging tool body 102 is being moved downward by a deployment force, applied as more fully described herein. The releasable latch members 127 are forced inward to release the latch 120 and allow the upper end 103 to slide downward. The lower end 104 also slides through and out the opening 118 into the surrounding well bore. The sensors 140 are monitoring the position of the tool body 102 relative to the garage 24. As shown in FIG. 10, the stop collar 132 ultimately lands on the stop ring 121 and the latch members 127 extend into the lower latch profile 114 to couple the latch 120 to the garage 24. The logging tool body 102 is now fully extended. The sensors 140 and all of the logging tools disposed therebelow are exposed to the surrounding well bore and formation. This also removes the logging tools from the metallic environment of the drill pipe garage, which negatively impacts operation of the logging tools.

Figure 11:
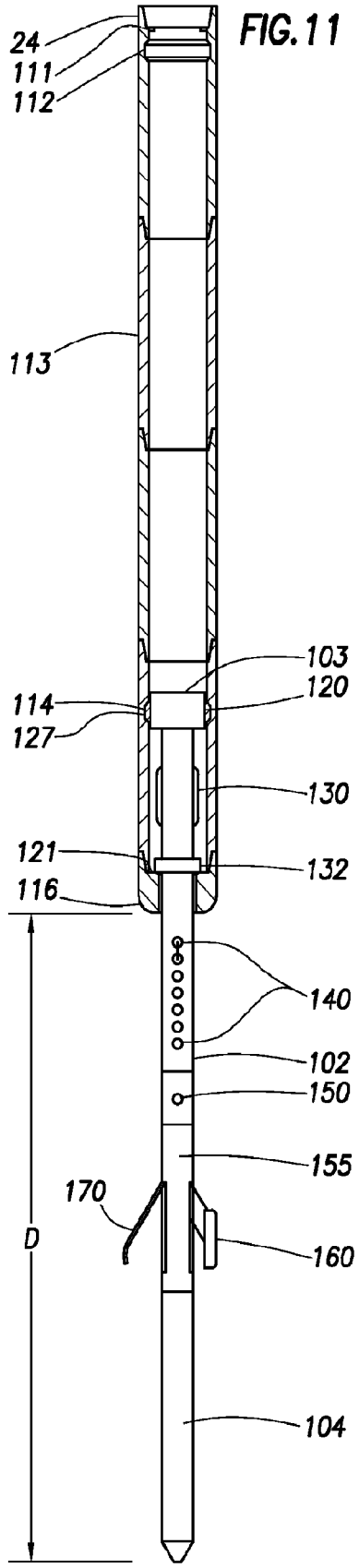

Referring to FIG. 11, the sensor pad 160 and the back up arm 170 are activated and extended by motors coupled thereto, or by other similar drive mechanisms. The logging tool assembly 100 is now fully extended and deployed, with a length D representing the fully extended length of the tool body end 104 with respect to the drill string end 116. The sensor pad 160 may engage the borehole wall, and the back up arm 170 will provide an opposing force to ensure the sensor pad remains engaged with the borehole wall. In some embodiments, when the position sensors 140 detect that they are still completely in the drill pipe garage 24, as in FIGS. 8 and 9, the logging tools are kept in the powered down state, saving critical battery power. Once the position sensors 140 detect that they have been deployed out the end 116 of the drill string, a controller in the electronics module uses this information to activate and power up the logging tools and motor open the arms 170 and the pads 160. The logging tools are ready to log and record data as the drill pipe is tripped out of the hole, as described with reference to FIGS. 3 and 4. In some embodiments, the position sensors 140 are always powered on. In alternative embodiments, the position sensors 140 are initially in a sleep mode and awaken upon a signal from a timing circuit, or a signal from other logging tool sensors that detect reaching a predetermined area of the well.

The logging tools can be damaged with compression forces easily provided by the drill pipe. If the logging tool body is disposed in a washout section or adjacent a ledge, the downward motion of the pipe is transmitted directly to the logging tools. To help protect the logging tools from damage, the tool body 102 is releasably secured in the garage 24 to allow for axial movement in response to outside forces. In some embodiments, the releasable latch 120 is provided to latch into the lower profile 114 when the tool body 102 is deployed. The latch 120 secures the tool body 102 to the bottom of the drill string, and will release the tool body 120 when a compressive force less than the safe load on the logging tool string is reached. In other embodiments, the latch 120 is removed. The stop collar 132 and stop ring 121 arrangement prevents axial movement of the tool body 102 in one direction, but movement in the opposite axial direction due to compressive or other outside forces is unimpeded. In these embodiments, the tool body 102 is allowed to move upward into the garage 24 in response to compressive forces between the drill pipe and the borehole. Other means for releasably securing the tool body 102 in the garage 24 are contemplated.

Figure 12:
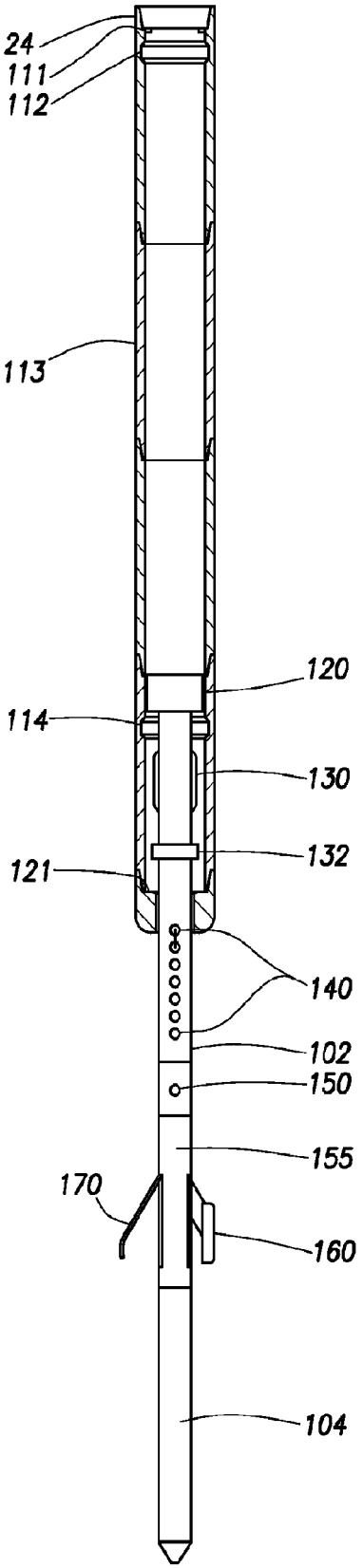
Figure 17:
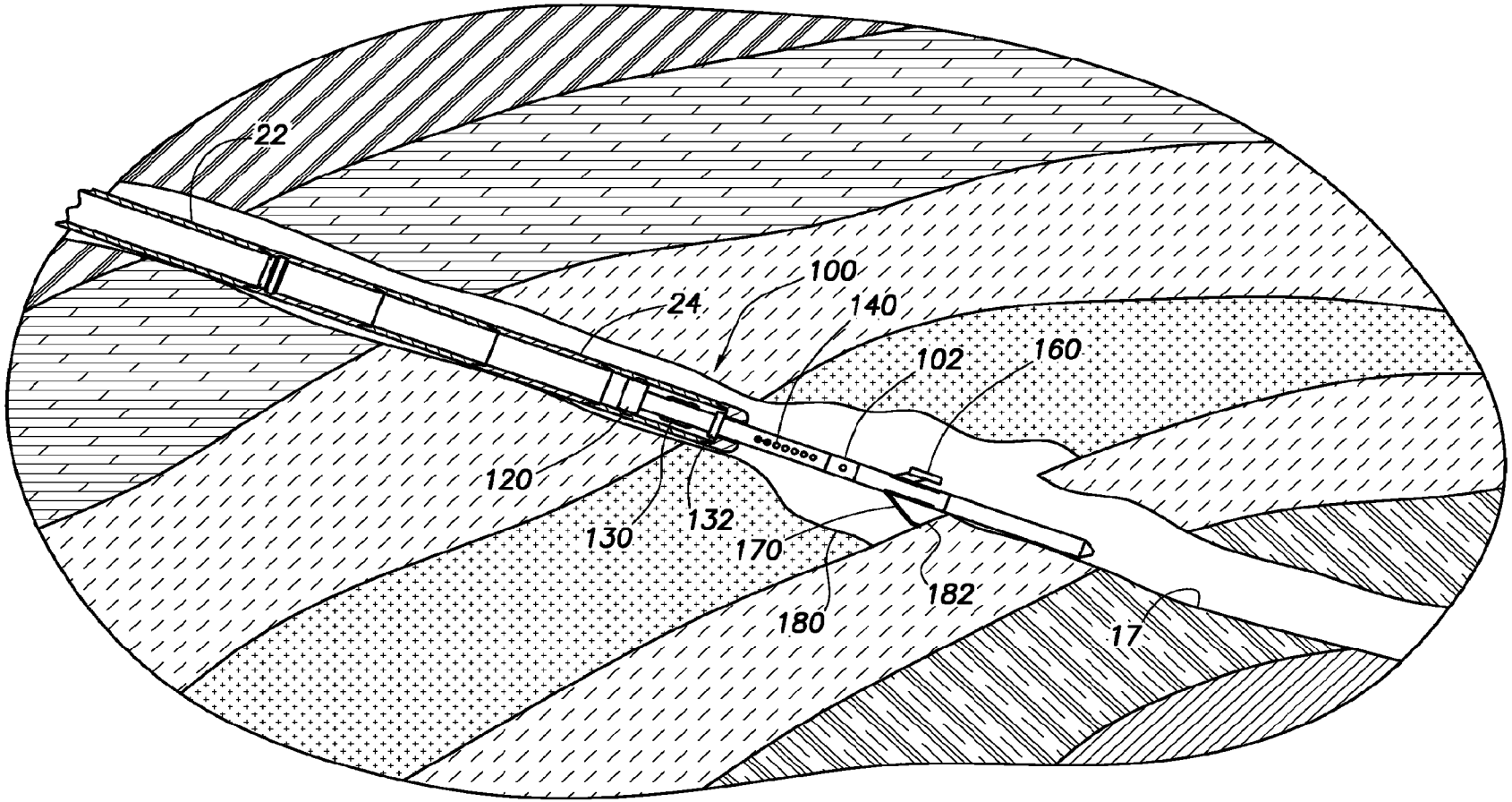
FIG. 17 is the pipe conveyed extendable well logging apparatus of FIG. 11 disposed in a well bore adjacent a washout section.
Figure 18:
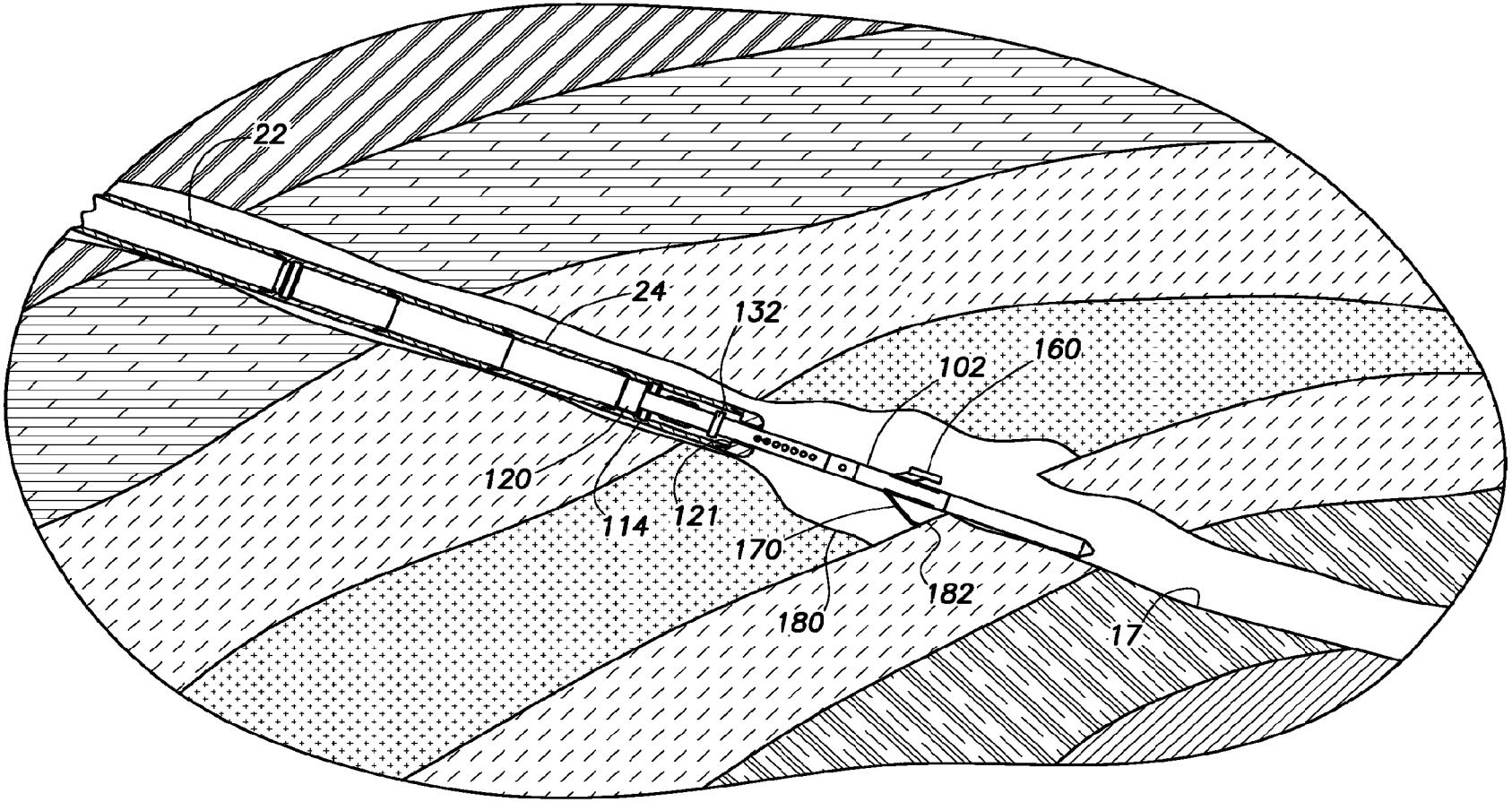
FIG. 18 is the pipe conveyed extendable well logging apparatus of FIG. 12 wherein the washout section has caused an upward movement of the logging tool.

Referring to FIG. 17, the fully deployed tool assembly 100 as shown in FIG. 11 is disposed in the borehole 17 that includes a washout section 180 and a ledge 182. The extended back up arm 170 is engaged with the ledge 182. Any movement of the drill pipe 22 downward will impart compressive forces on the tool body 102 due to the reaction force of the ledge 182, but for the upward releasability of the tool body 102. As shown in FIGS. 12 and 18, the latch 120 releases from the profile 114 in response to the drill pipe force and external ledge force that exceed a predetermined threshold that is less than the safe load for the logging tool body 102. The stop collar 132 raises up from the stop ring 121. In alternative embodiments, the latch 120 and profile 114 are removed from the assembly, allowing the stop collar 132 to freely release from the stop ring 121. In this manner, the tool body 102 is free to release and move upward in the garage 24 without any hindrance from the latch.

Downward movement of the drill pipe 22 sometimes occurs even while movement of the tool assembly 100 during logging is generally upward in the borehole. For example, tripping out of the hole with the drill pipe 22 requires a process that periodically causes the drill pipe to move back down the borehole. As each stand of drill pipe is removed, manipulations of the remaining drill string causes the drill string to move in the borehole on the order of 2-5 feet. The logging tools are designed to be pulled continuously out of the hole once the arms and pads are deployed. If the logging tools are forced to go downhole with the arms and pads open, they could catch on rugosity in the borehole (FIGS. 17 and 18) and be damaged or broken away from the tool string. Some logging tools have radioactive sources in their pads. If the radioactive source became lost in the hole, it is costly to either fish it out or take other required actions if it cannot be fished.

The logging data is of diminished value if it is not able to be aligned or properly correlated with the depth at which it was measured. Depth control is a fundamental aspect of logging. There are means in the industry for determining the depth of the end of the drill pipe, and any such means is used in determining the depth of the end 116 of the drill pipe 22 for the pipe conveyed logging as described herein. If the tools are not latched or secured into the drill pipe, an uncertainty as to their actual position is introduced. By reducing the distance D of a fully extended tool body 102 relative to the drill string end 116, error is introduced into the logging data which is a function of depth. By using the position sensors 140, the relative position between the logging tools and the drill pipe can be monitored. The uncertainty is measured and recorded by the logging system along with the other data being collected, and is used to correct the depths from the drill pipe depth measurement system.

Thus, in some embodiments, if the drill pipe 22 then resumes moving uphole from the slightly adjusted positions of FIGS. 12 and 18, the tool body 102 will reset against the lower stop ring 121 to the fully extended and deployed position, logging will continue without damage to the logging tools, and the position sensors 140 will note any depth offset as described above.

In some circumstances, if the tool body 102 is pushed away from the stop ring 121 or out of the latch 120, well bore debris may enter the drill pipe opening 118 and prevent the tool body 102 from immediately returning to its fully extended and deployed position as the tool assembly 100 is pulled further uphole for logging and withdrawn from the well. Thus, the logging tool body 102 may not always be fully deployed out the end of the drill pipe while logging data is being collected. To correct for this, the position sensors 140 can continuously measure and log the position error of the tool body 102 relative to the drill pipe, which in turn allows the system to correct the depths from the drill pipe depth measurement apparatus for as long as the positions sensors 140 read an error in the distance D.

If the tool body 102 is retracted into the drill pipe garage 24 beyond a certain distance as determined by the positions sensors, it may be desirable to close the arms 170 and the pads 160 and power down the logging tools to protect the tools from damage and conserve battery power. The default position of the assembly 100 is that the logging tools stay fully deployed as the pipe 22 is withdrawn from the hole. The tools could be retracted into the drill pipe garage 24 as previously described by the pipe 22 being lowered downhole while rugosity holds the tools in place, or even by a pressure differential between the borehole and the inside of the drill pipe. When the position sensors determine that a substantial portion of the tool body 102 has re-entered the drill string garage 24, the controller can initiate the commands to motor the arms and pads closed and power down the tool string. This action serves to protect the arms and pads and conserve battery power when logging data would not be valid anyway.

Figure 13:
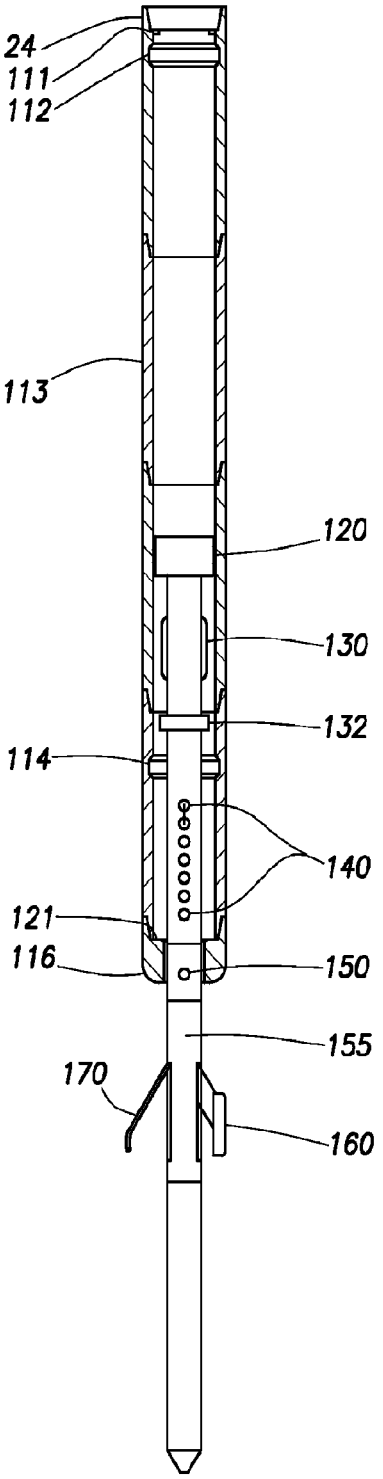

In corresponding embodiments, and with reference to FIG. 13, the tool body 102 is pushed far enough into the garage 24 that the emergency position sensor 150 is tripped by the end 116 of the drill pipe garage 24. A signal sent from the sensor 150 to the controller (such as one disposed in the electronics module in sub 104 or elsewhere) initiates the controller to command that the pads 160 and arms 170 retract as shown in FIG. 14.

Figure 14:
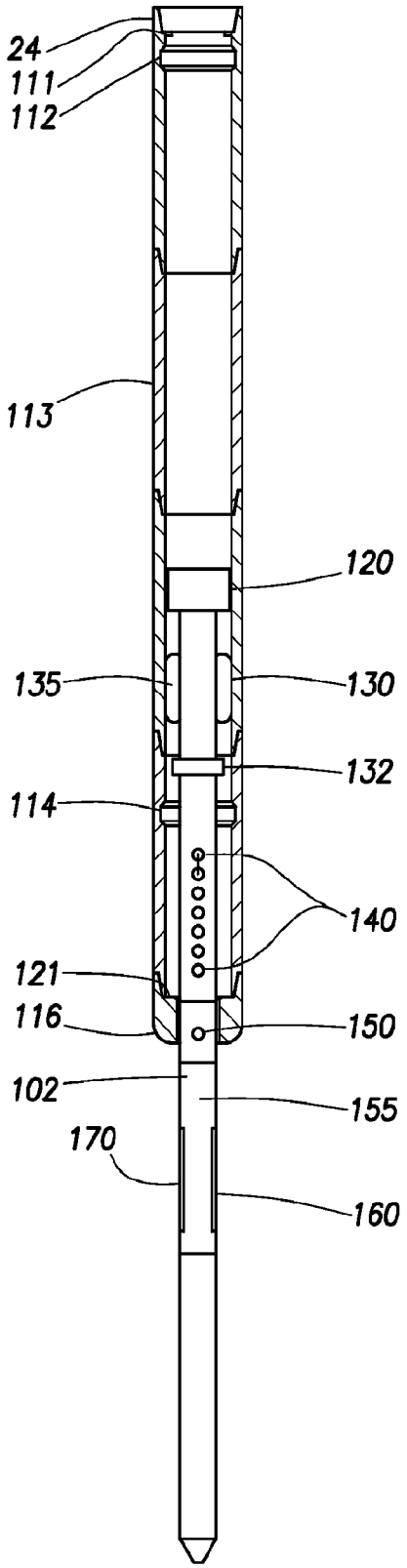
Figure 15:
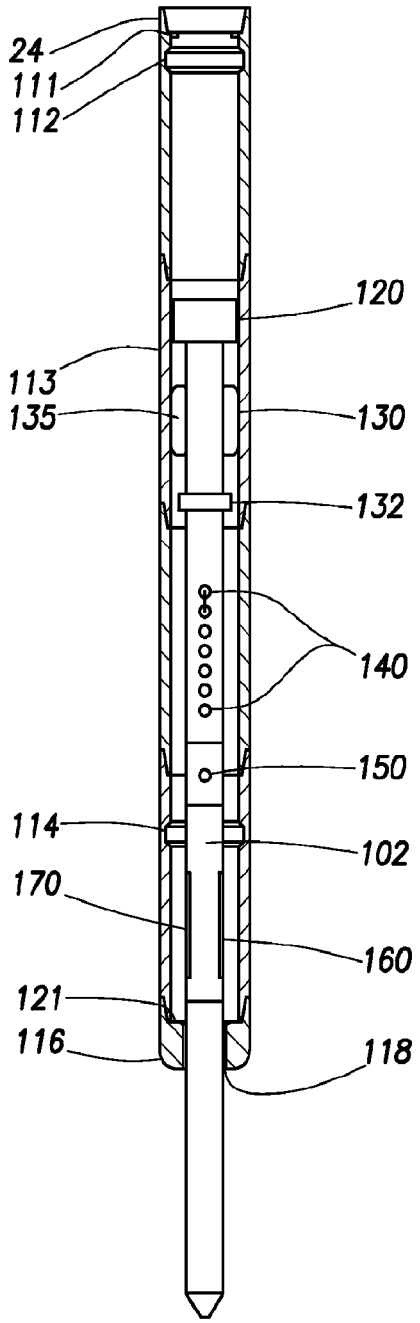
Figure 16:
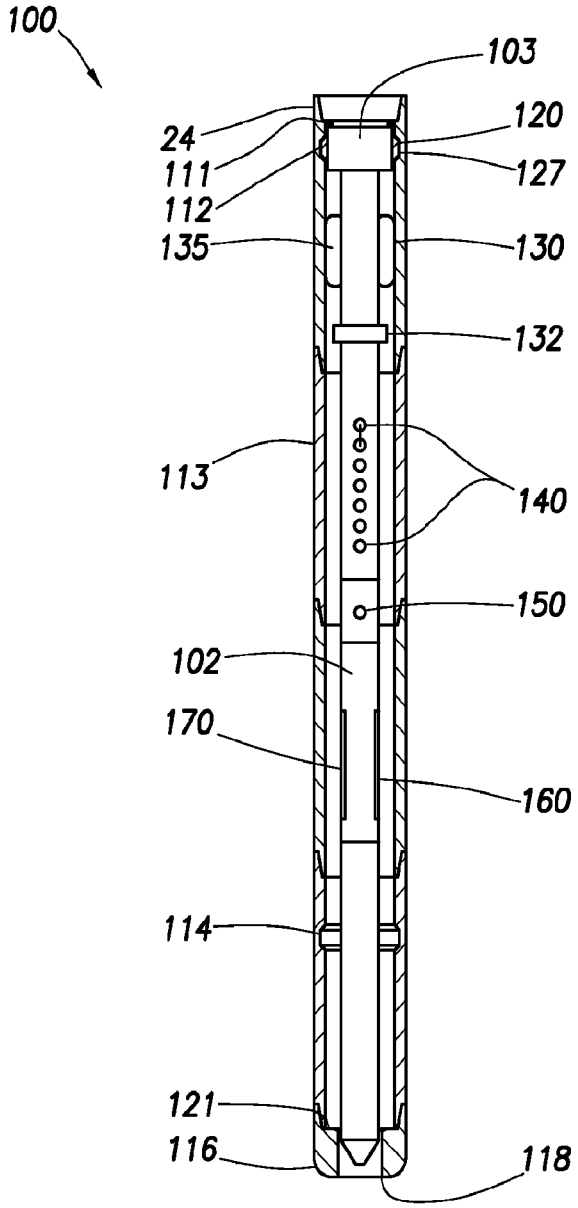

In further embodiments, and still referring to FIG. 14, the emergency signal sent from the sensor 150 to the controller also initiates the tractor 130 and powers it up. Traction members 135, which had previously been retracted away from the inner surface of the garage 24, are extended into gripping engagement with the garage 24. The tractor 130 is operated to pull the tool body 102 upward through the opening 118 and back into the garage 24, as shown in FIG. 15. The tractor continues to retract the tool body 102 until the upper end 103 has abutted the upper stop ring 111 and the latch 120 has re-latched by extending the latch members 127 into the profile 112, as shown in FIG. 16. The tool body 102 and tool assembly 100 are now back to the fully retracted positions as originally shown in FIG. 8. Other means for retracting the tool body 102 are also described herein.

In additional embodiments, the tractor system 130 is used for extension of the tool body 102. Referring back to FIG. 8, while the assembly 100 is in the pre-deployed or retracted position, the tractor 130 can be activated and engaged with the garage 24 as previously described. The tractor 130 is used to move the tool body 102 downward to the extended position as shown in FIGS. 8-10. The tractor 130 can then also be used to move the tool body 102 back upward to the retracted position as shown in FIGS. 14-16.

In addition to retracting the tool body 102 as described above as a reaction to the tool body being accidently retracted back into the drill pipe by external forces, some embodiments include purposeful and controlled retraction of the tool body 102. Further embodiments also include subsequent re-extension of the tool body 102 for logging. For example, it is advantageous during a logging operation to run a repeat section where a portion of the well is logged twice or more. The logged data can be compared between the two or more repeated log sections to verify proper tool operation. Due to the retractability of the logging tools, the tool assembly 100 can be moved up and down in the well to perform multiple logs in a single trip down the primary well bore 12, while avoiding the inherent dangers of moving a deployed logging tool downward in the borehole. In exemplary embodiments, the logging assembly 100 is deployed and logged as shown in FIGS. 3 and 4. In FIG. 5, a means for retracting the tools back into the drill pipe ensures that the tool assembly 100 can be safely transported back downhole to the position of FIG. 3. Once safely back downhole, the tools would be redeployed out the end of the drill pipe, powered up, motored open, and logging would continue as the tools are transported back uphole by the drill pipe, as shown in FIG. 4. In exemplary embodiments, the logging tool extension and retraction means includes various combinations of the tractor means, as previously described, and the differential pressure system means, as described more fully below.

In some embodiments, it is only necessary for the position sensor to function over a small portion of the axial length of the tool body, such as the axial length of the position sensor array 140 as shown in FIGS. 8-18. In certain embodiments, the position sensor array 140 detects movement at least a distance equal to the maximum distance the drill string will move downhole when a joint of pipe is removed from the drill string, e.g., 2-5 feet. Once the logging sensors are inside the drill pipe garage, their effectiveness will be diminished or completely negated. Sensing the position of the tools in the drill pipe over a limited range simplifies the sensor or sensor array implementation.

Figure 19:
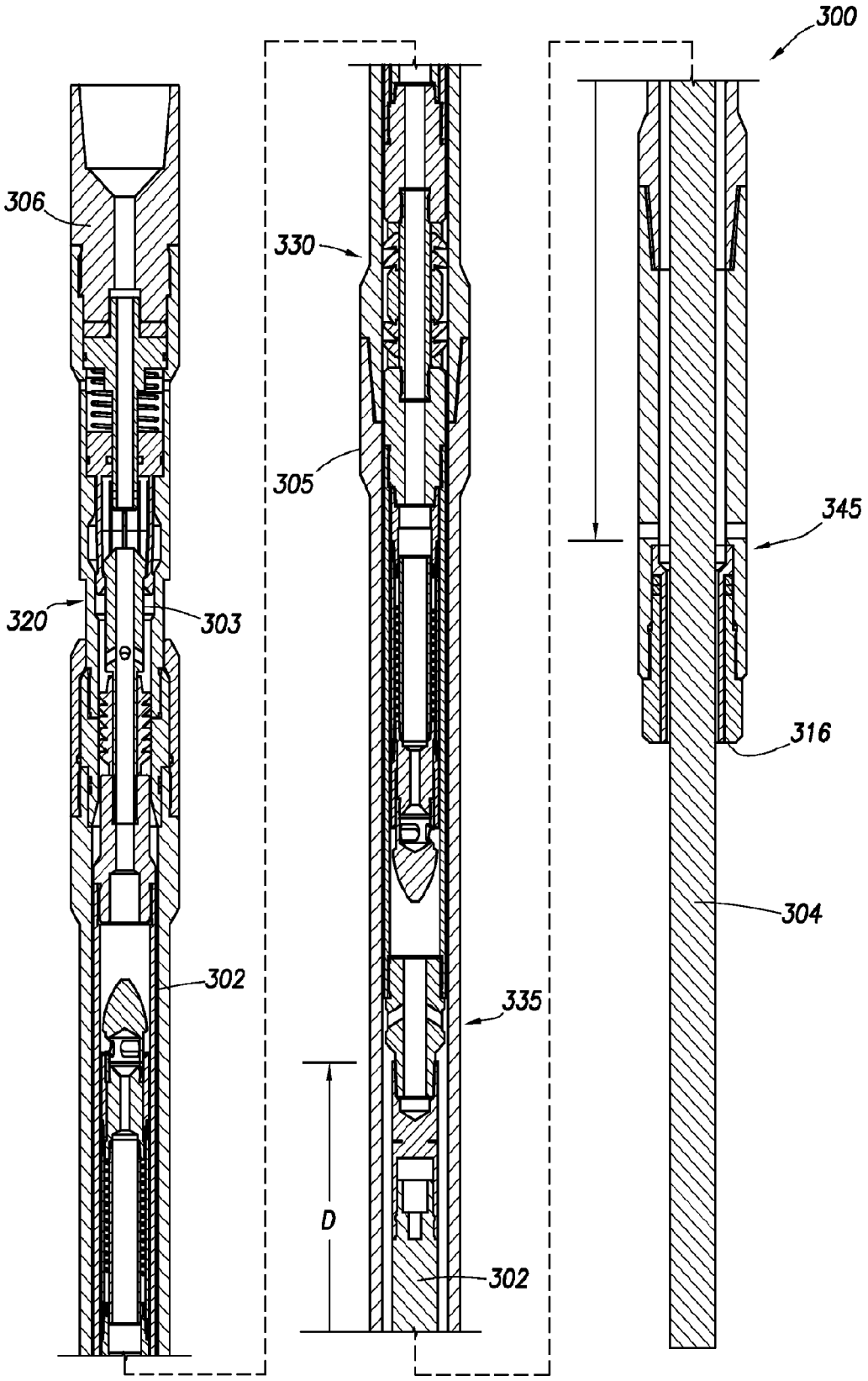
FIG. 19 is a cross-section of an embodiment of a pressure differential deployment system for a pipe conveyed extendable well logging apparatus in accordance with principles disclosed herein.

In further embodiments, the tool assembly uses a differential pressure deployment system to extend and retract the logging tool body. Referring now to FIG. 19, the logging tool assembly 300 includes an upper connector 306 and a logging tool body 302 disposed in an outer housing or garage 305 with a lower end 316. The tool body 302 includes an upper fishing neck member 320 latched into a collet 322 with radially extendable fingers to form a collet connection 320. An intermediate portion of the logging tool body includes a bi-directional valve system 330 disposed in the garage 305. In certain embodiment as described herein, the valve system 330 may also be referred to as a velocity valve, a two-way valve, or a rate dependent valve, or combinations thereof. Below the valve 330 is a landing member 335 and the remainder of the tool body 304 including the logging devices. The lower end 316 of the garage 305 includes a landing sub or seat 345. The assembly 300 is shown in a latched and retracted position, with distance D representing the maximum extension or retraction distance of the tool body 302 relative to the housing 305.

Figure 20:
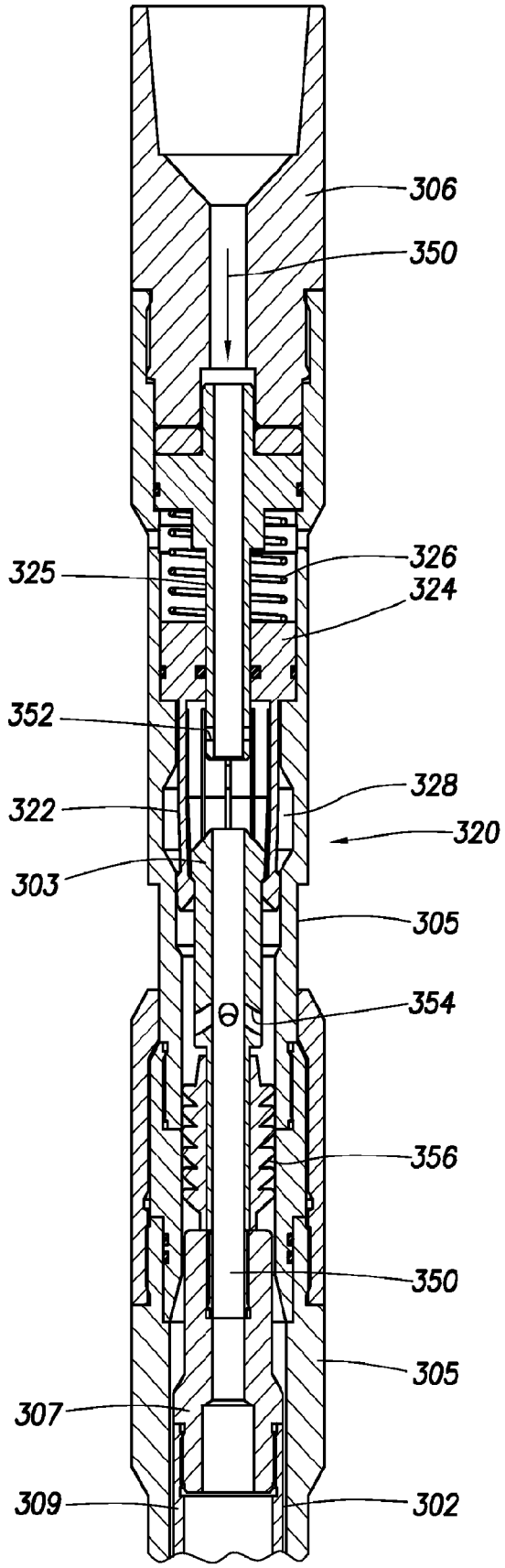
FIG. 20 is an enlarged upper portion of the pressure differential deployment system of FIG. 19 with a collet connection.

Referring now to FIG. 20, an enlarged portion of the tool assembly 300 shows the collet connection 320. The fishing neck 303 is capture by the collet fingers 322 which are forced radially inward by the garage housing 305 just below a cavity 328. The collet fingers 322 are coupled to a piston 324 that slidably interacts with an inner stem 325 and a biasing spring 326. The fishing neck member 303 also includes a series of rubber or elastomeric cups 356 that are angled to be able to form to an inner diameter into which they are disposed, and also to receive fluid and pressure up on an upper side of the cups 356 and to allow fluid to bypass and receive little resistance on a lower side of the cups 356. A lower end 307 of the fishing neck member 303 is coupled into a valve tubing 309 to make up a portion of the tool body 302. The tool assembly 300 includes a primary fluid flow path 350 including stem ports 352 and fishing neck ports 354 for various additional flow paths for bypassing portions of the primary fluid flow.

Figure 21:
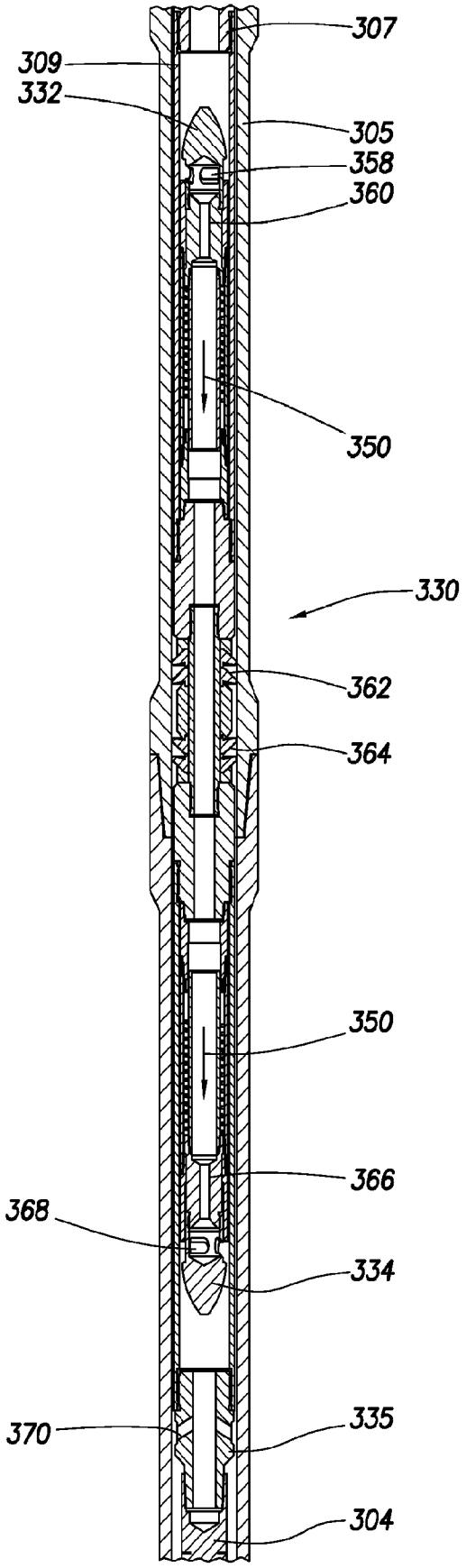
FIG. 21 is an enlarged intermediate portion of the pressure differential deployment system of FIG. 19 with a bi-directional rate dependent valve system.

Referring now to FIG. 21, the valve system 330 is shown disposed below the fishing neck and collet connection 320. An upper cup 332 includes ports 358 and a restriction 360 of the primary fluid flow path 350. An intermediate portion of the valve 330 includes an upper set of rubber or elastomeric cups 362 that are angled to be able to form to an inner diameter into which they are disposed, and also to receive fluid and pressure up on a lower side of the cups 362 and to allow fluid to bypass and receive little resistance on an upper side of the cups 356. A lower set of rubber or elastomeric cups 364 are angled to be able to form to an inner diameter into which they are disposed, and also to receive fluid and pressure up on an upper side of the cups 364 and to allow fluid to bypass and receive little resistance on a lower side of the cups 364. An lower cup 334 includes ports 368 and a restriction 366 of the primary fluid flow path 350. Coupled to a lower end of the valve 330 is the landing or seat member 335 having bypass ports 370. The landing member 335 is coupled to the lower logging device section 304.

Figure 22:
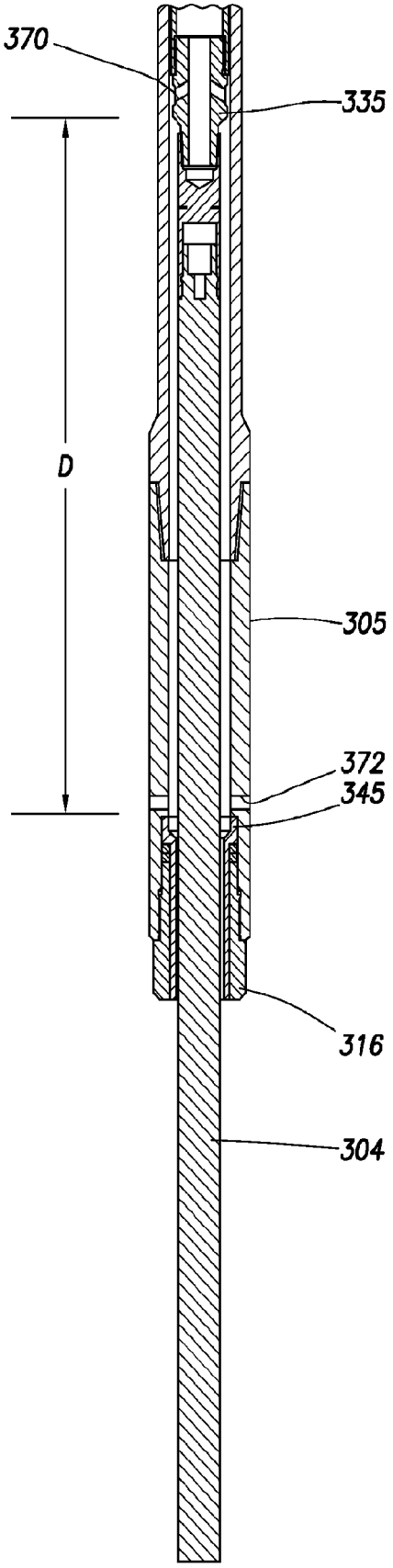
FIG. 22 is an enlarged lower portion of the pressure differential deployment system of FIG. 19 with a landing sub and logging devices.

Referring now to FIG. 22, the lower end of the logging assembly 300 is shown. The lower member 316 receives the slidable logging section 304. The lower member 316 also includes a seat 345. The housing 305 includes fluid ports 372.

In exemplary embodiments, the valve system 300 (and system 400 as is described more fully below) includes a valve that closes as the fluid flow rate therethrough is increased. The valve may also be referred to as a velocity valve or a rate dependent two-way valve. The valve system includes an arrangement of cups and flow restrictions that respond to flow rate increases to move the valve and the logging tool body in a specific direction, e.g., either axially upward or axially downward to retract and extend the logging tools, respectively. A fluid flow controlled at a low rate will not activate the valve. The valve system is configured to receive a flow rate increase and create a pressure differential in the tool assembly to either retract or deploy the logging tools. The logging tools can be latched in the retracted position, such as by the collet connection 320. The logging tools can remain latched even as the well is circulated.

Figure 23:
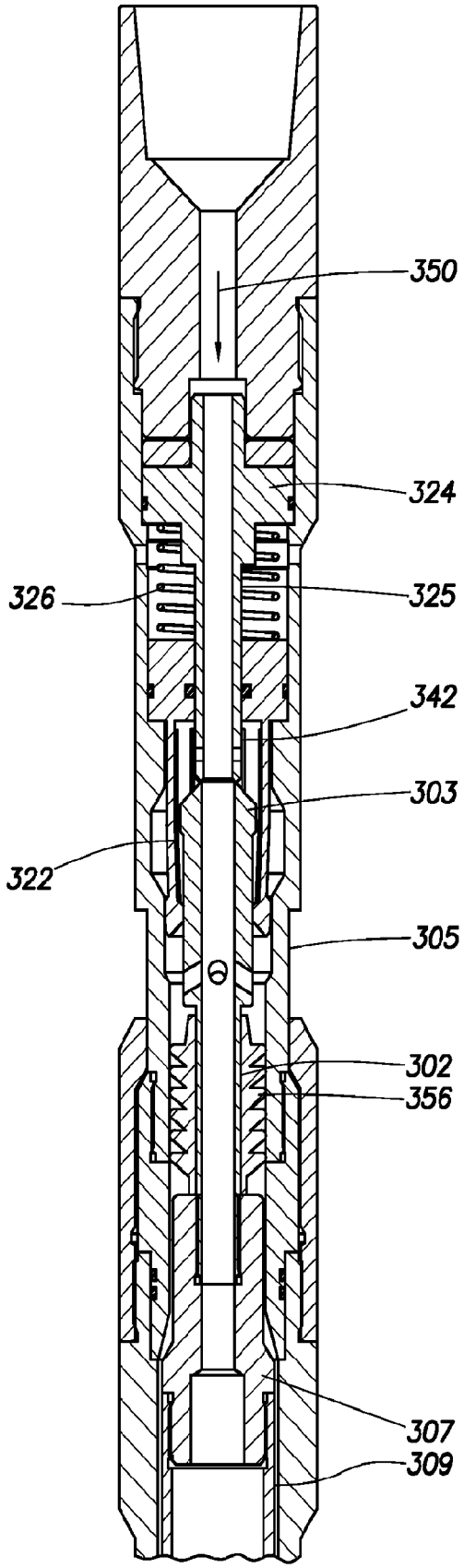
FIG. 23 is the collet connection of FIG. 20 in a pressure up position.
Figure 24:
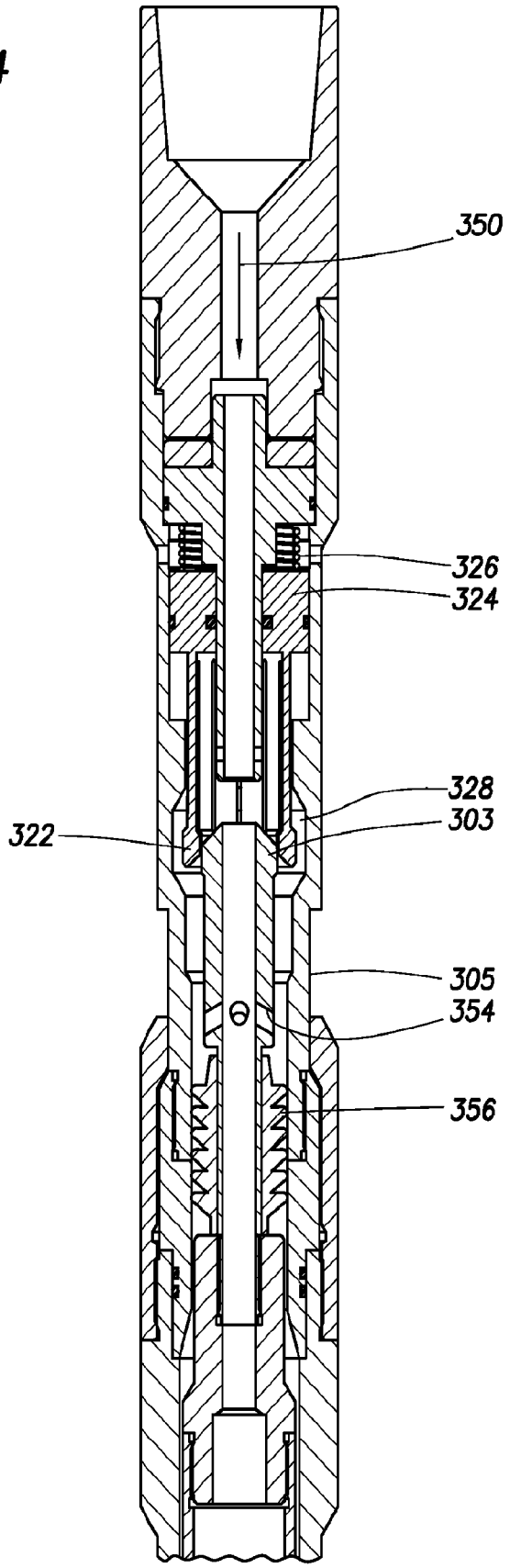
FIG. 24 is the collet connection of FIG. 23 released position.
Figure 25:
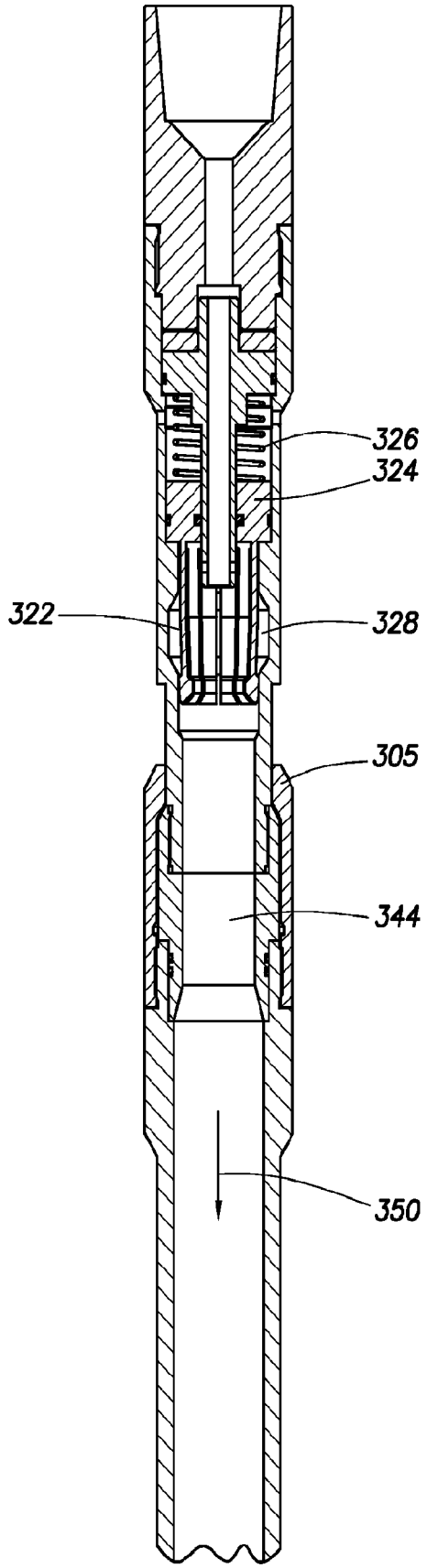
FIG. 25 is the collet connection of FIG. 24 in a further released position with the logging tool body displaced downwardly.

Referring to FIG. 23, the primary fluid flow rate 350 is increased. This rate increase will create a higher pressure in the tool assembly housing 305 relative to the pressure above the valve 330 and tool body 302. The relative pressure differential will lift up the valve system 330 and the tool body 302 relative to the collet fingers 322 until the fishing neck 303 engages the lower end 342 of the stem 325. The relative pressure differential is now transferred to the bottom of the piston 324, forcing the piston 324 upward against the biasing spring 326 as is shown in FIG. 24. The upwardly disposed piston 324 also releases the collet fingers into the cavity 328, thereby allowing them to extend radially outwardly to release the fishing neck 303 as is also shown in FIG. 24. The fishing neck 303 is now free of the collet connection, and the tool body 302 is carried downwardly by the primary fluid flow 350. With reference to FIG. 25, the piston 324, the spring 326 and the collet fingers 322 are now free to displace downwardly to their original positions, except the tool body 302 has been released and carried downwardly by the flow 350.

Figure 26:
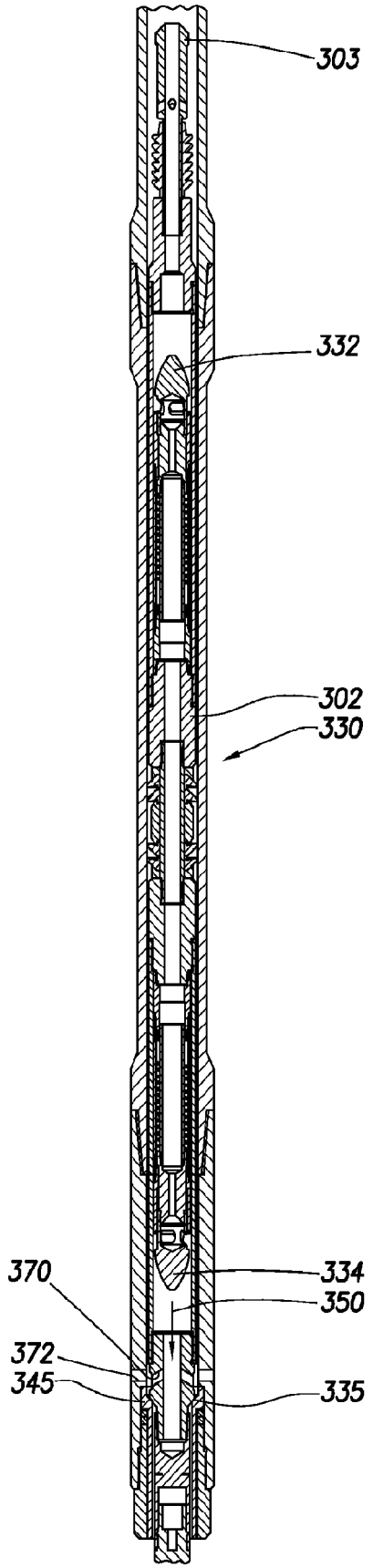
FIG. 26 is the valve system of FIG. 21 in a downwardly displaced deployed position.
Figure 27:
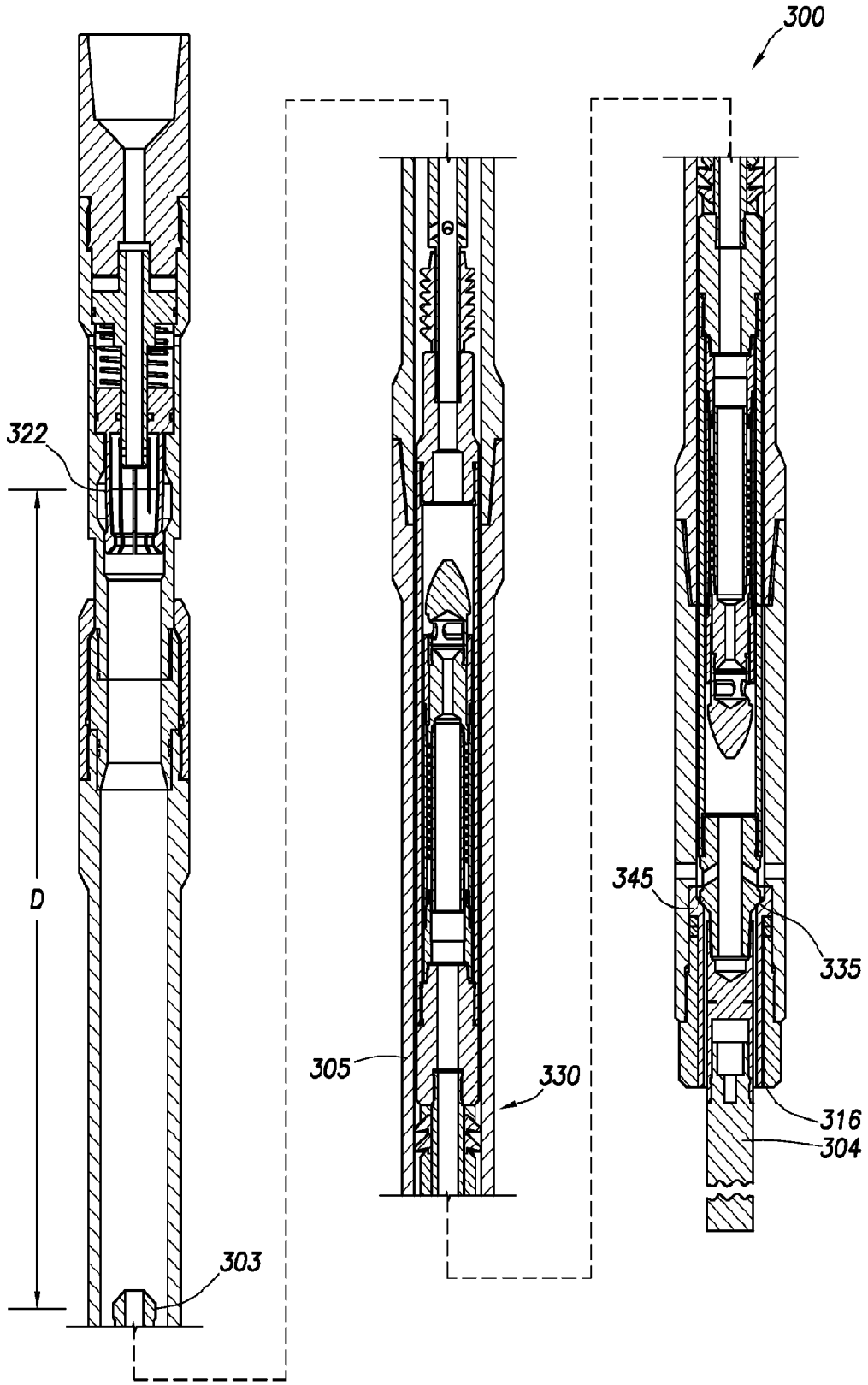
FIG. 27 is the pipe conveyed well logging apparatus of FIG. 19 as extended by the pressure differential deployment system.

Referring to FIG. 26, the downwardly displaced valve and tool body are shown seated. The landing member 335 is seated in the landing sub 345 while the ports 370 are aligned with the ports 372 to allow the fluid flow 350 to circulate with the well. Thus, the rate and pressure differential valve 330 has displaced the axially moveable tool body 302 to a fully extended position as shown in FIG. 27. The tool body 302 and the logging device section 304 are extended a distance D relative to the garage housing 305 and its end 316.

To retract the tool body 302, the pressure above the tool body 302 is reduced by manipulating the fluid flow 350 to create a negative pressure differential above the tool body 302. In other embodiments, the tool body 302 is retracted by pumping down the annulus of the well and up through the drill pipe end 316 to create a positive pressure differential below the tool body 302. In further embodiments, the positive pressure differential below the tool body 302 is created by swabbing the drill pipe (i.e., manipulating the dill pipe to removed fluid from the lower parts of the drill pipe). In response, the bi-directional or two-way system 330 of valves, cups and flow paths will react to displace the tool body upwardly in a manner similar to that described for extension. The tool body 302 and thus the logging tools 304 will then be retracted and latched into the collet connection 320 in a manner opposite to the process described with reference to FIGS. 20-25. The lower positive pressure differential will force the piston 324 and collet fingers 322 to the position of FIG. 24, where the collet fingers can receive the fishing neck 303 in the cavity 328. The pressure differential is reduced, and the piston 324 and collet fingers 322 release (FIG. 24) and then capture the fishing neck 303 (FIG. 20). At this time, the tool assembly 300 can be removed from the well or moved to another section of the well to be re-deployed for further logging as described herein.

Figure 28:
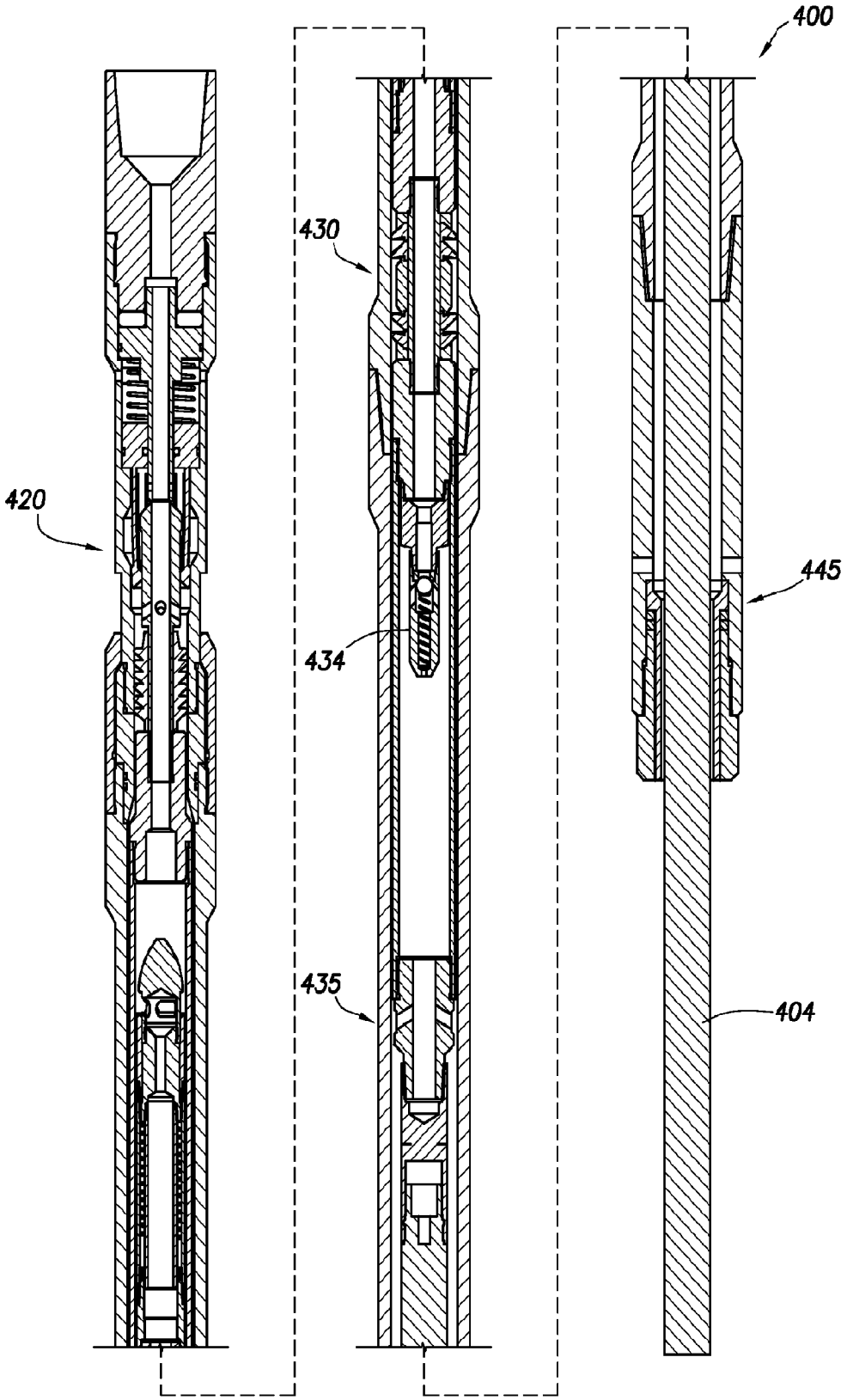
FIGS. 28 and 29 depict an alternative embodiment of a pressure differential deployment system with a ball and spring bi-directional rate dependent valve system.
Figure 29:
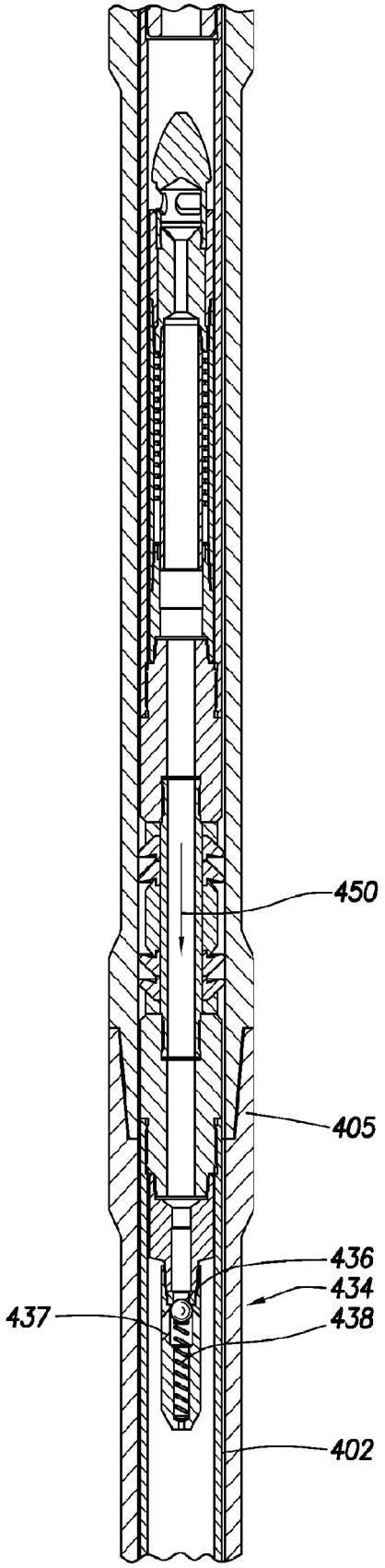
Figure 30:
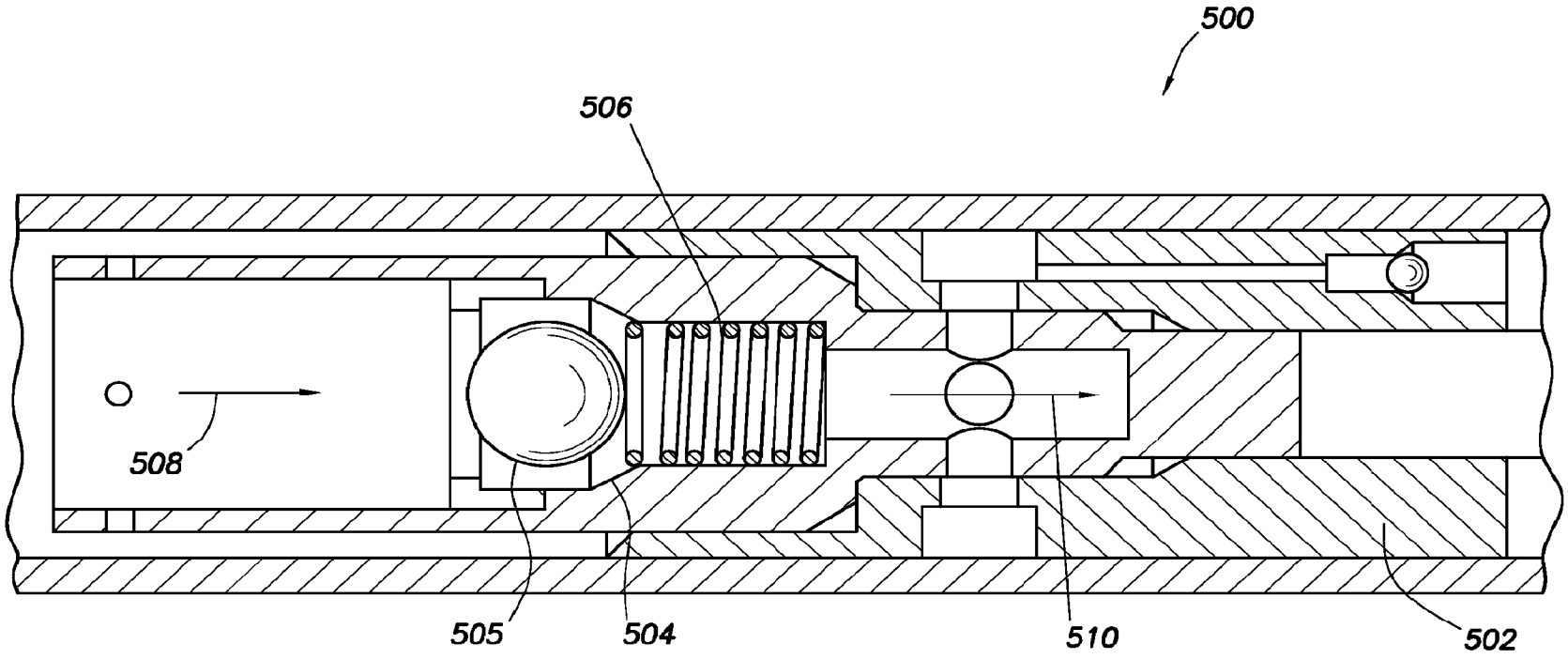
FIG. 30 is an alternative flow rate and pressure differential mechanism for extending and retracting logging tools, including a ball and spring valve.

In a further embodiment of the valve system, with reference to FIGS. 28 and 29, a valve 430 including a lower ball and spring valve 434 replaces the valve 330. Other portions of the assembly 400 are similar to corresponding portions of the assembly 300. The lower valve 434 includes a ball 436 biased to an upper position by a spring 438 to block ports 437. This position provides a lower flow restriction for the downward flow of fluid 450. At a predetermined pressure differential across the ball 436, the spring 438 compresses to open the ports 437 and allow fluid bypass. The biased upward ball 436 also provides a fluid flow restriction for a fluid flow opposite of flow 450. The valve 434 may be operated in the same bi-directional rate dependent valve systems as described herein to achieve extension and retraction of the logging tools.

In another embodiment, the rate dependent bi-directional valve includes a different ball and spring valve 500. A ball 505 is biased upwardly by a spring 506 to allow a primary fluid flow 508 to bypass to flow 510. As the rate of the flow 508 is increased, the ball 505 will compress the spring 506 and close onto a seat 504. This restricts or closes the flow 508 and provides a positive pressure differential on the tool body 502 below. The flow rate can be decreased or otherwise negative pressure differentials can be introduced as discussed herein to adjust the pressure differential across the valve 500 and displace the tool body 502 and the valve 500 upwardly again.

The embodiments described herein provide a combination of features that aid in control and physical protection of logging tools when conveyed on pipe. Certain embodiments include a fully retractable pipe conveyed logging system combining a pipe conveyed deployment system such as one that works by pressure or a battery operated tractor, a sensor for detecting where the tool string is in the drill string, and a wireline logging tool string. Deployment of the logging tools is achieved by the tractor system, the differential pressure deployment system, or combinations thereof as described herein, as well as systems consistent with the teachings herein. The logging tools are deployed from the drill pipe until they reach a stop at full deployment or latched into the deployed position with a releasable latch. The position sensor provides one type of position feedback, detecting when the logging tools are deployed outside of the drill pipe and would signal the controller to power up and open the tools, possibly after a short time delay to insure complete deployment. During logging, the position sensors provide another type of position feedback, measuring any change from the fully deployed position and that distance is used for depth correction. An accelerometer is currently used in many logging tool strings. The accelerometer can sense when the tools are motionless. The controller can use this information, such that after being held motionless for a predetermined amount of time, the controller will retract the arms, power down the logging tools, and signal the tractor to power up and retract the tools into the drill pipe. In some embodiments, the position sensor determines that the tractor has moved the logging tools fully inside the drill pipe, which signals the tractor to power down. The latch may latch the logging tool string back into the original protected position inside the drill pipe. The tools can then be redeployed as desired by pressure or other means by the deployment system after the drill pipe is repositioned as desired. The logging tools can also be retracted and re-extended using the differential pressure deployment systems.

If well conditions caused the tools to be pushed further into the pipe than allowable during logging, the controller would close the arms, power down the tool string, and signal the tractor to power up and fully retract the tool string into the pipe. This would protect the tool string from possible damage. Note that there are methods known and used in deployment systems to tell at the surface whether the tools are in their safe run in hole position or in their deployed position by pumping and noting the flow rate and pressure.

By combining all of these elements as described, a system can be built that allows control and feedback to convey tools downhole in a protected garage on drill pipe, deploy the tools on command from the surface, provide depth correction and emergency retraction during logging, retract the tools on command from the surface, and re-deploy the tools at will. This provides the ability to safely trip back downhole to log a repeat section.

A desirable operational procedure with this system is to check for tool position at the end of the logged interval. If the tools are in their extended position it would be assumed that the interval was properly logged. If the tools were in the retracted position, it would be assumed they retracted due to an emergency condition while logging the interval. If they were found to have retracted, they could be lowered, redeployed, and the interval re-logged. This procedure will help insure that the desired logging data is obtained before tripping the tools out of the hole.

The embodiments described herein include extendable and retractable logging tools with a position sensor or sensors. The sensor or sensor array may be arranged with the drill pipe conveyed logging tools to provide enhancements and protection to the fragile logging tools when deploying in a downhole environment. In some embodiments, the logging tools may be run without being rigidly latched into the bottom of the drill pipe in their deployed position. Non-rigid latching of the logging tools to the drill pipe protects the tools during tripping out of the well, and is a building block for tool retraction and redeployment. Non-rigid latching may cause relative depth drift for the logging tools, due to the relative distance between the logging tools and the end of the drill pipe being adjusted from a known or expected value by borehole conditions. In some embodiments, the logging tool assembly provides for depth correction when the logging tools are not rigidly latched into the drill string in their deployed state. The sensor or sensor array is used to detect the position of the logging tools relative to the end of the drill pipe conveyance. Thus, the logging tools can be deployed from the end of the drill pipe and a means for sensing the position of the logging tools relative to the end of the drill pipe is provided. This information can then be used to power up and power down the logging tool assembly, and for relative depth correction between the logging tool assembly and the drill pipe conveyance while logging to improve measurement accuracy. Further, in some embodiments, features are provided in the logging tool assembly and drill pipe garage for retracting the tools into the drill pipe, then re-deploying and re-logging a well interval. Thus, the operator can run repeat sections with drill pipe conveyed logging tools in accordance with the principles taught herein.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A pipe conveyed well logging assembly comprising:

a downhole pipe including a garage;

a logging tool disposed in the garage and extendable therefrom;

a retraction system located downhole and configured to retract the logging tool into the garage while downhole, wherein the retraction system includes a tractor; and a releasable latch releasably engageable with the garage to retain the logging tool in and release the logging tool from the garage.

2. The pipe conveyed well logging assembly of claim 1, wherein the tractor is moveably coupled between the logging tool and the garage to retract and extend the logging tool while downhole.

3. The pipe conveyed well logging assembly of claim 1, wherein the logging tool comprises a controller coupled to the tractor.

4. The pipe conveyed well logging assembly of claim 3, wherein the logging tool comprises a sensor coupled to the controller, and the controller controls the tractor in response to a signal from the sensor.

5. The pipe conveyed well logging assembly of claim 1, wherein the retraction system includes a pressure differential mechanism.

6. The pipe conveyed well logging assembly of claim 5, wherein the pressure differential mechanism includes a bi-directional valve.

7. The pipe conveyed well logging assembly of claim 5, wherein the pressure differential mechanism includes a flow rate dependent valve.

8. The pipe conveyed well logging assembly of claim 5, wherein the pressure differential mechanism includes a velocity valve.

9. The pipe conveyed well logging assembly of claim 5, wherein the pressure differential mechanism includes a ball and spring valve.

10. A pipe conveyed well logging assembly comprising:

a downhole pipe including a garage;

a logging tool locatable in the garage and extendable therefrom to an extended position;

a releasable stop configured to hold the logging tool in the extended position and selectively allow retraction of the logging tool back into the garage; and a position sensor locatable downhole to identify a position of the logging tool relative to the downhole pipe.

11. The pipe conveyed well logging assembly of claim 10, wherein the position sensor includes an axially displaced sensor array.

12. The pipe conveyed well logging assembly of claim 10, wherein the position sensor includes at least one of a series of point sensors, a magnet, a series of mechanical switches, and a long stroke linear sensor.

13. The pipe conveyed well logging assembly of claim 10, wherein the position sensor is configured to provide a feedback to a controller coupled thereto.

14. The pipe conveyed well logging assembly of claim 13, wherein the controller is configured to use the feedback to control the logging tool.

15. The pipe conveyed well logging assembly of claim 13, wherein a memory in the logging tool is configured to collect the feedback for a depth correction of the pipe.

16. The pipe conveyed well logging assembly of claim 10, wherein the releasable stop includes a stop collar coupled to the logging tool and a stop ring coupled to the garage.

17. The pipe conveyed well logging assembly of claim 10, wherein the releasable stop includes a releasable latch engageable with the garage.

18. The pipe conveyed well logging assembly of claim 10, wherein the releasable stop is configured to allow retraction of the logging tool in response to an external force.

19. A method of deploying a pipe conveyed well logging assembly comprising:

disposing in a borehole a pipe including a garage housing a logging tool;

lowering the logging tool below a selected well zone using the pipe;

extending the logging tool from the garage;

deploying logging devices from the logging tool;

moving the logging tool up the borehole with the pipe while collecting logging data with the logging devices;

retracting the logging tool into the garage; and detecting a retraction distance of the logging tool relative to the garage.

20. The method of claim 19, further comprising:

moving the logging tool down the borehole after retracting the logging tool;

re-extending and re-deploying the logging tool and logging devices; and re-logging a well zone.

21. The method of claim 19, further comprising removing the logging tool and pipe from the borehole.

22. The method of claim 19, wherein the logging tool is retracted in response to an external force.

23. The method of claim 22, wherein a retraction system is activated to fully retract the logging tool.

24. A method of deploying a pipe conveyed well logging assembly comprising:

disposing in a borehole a pipe including a garage housing a logging tool;

lowering the logging tool below a selected well zone using the pipe;

extending the logging tool from the garage;

deploying logging devices from the logging tool;

moving the logging tool up the borehole with the pipe while collecting logging data with the logging devices;

releasing and retracting the logging tool into the garage in response to an external force on the pipe or the logging tool; and detecting a retraction distance of the logging tool relative to the garage.

25. The method of claim 24, further comprising correcting a depth measurement of the pipe using the retraction distance.

26. The method of claim 24, further comprising re-extending the logging tool when the external force is removed.

27. The method of claim 24, further comprising using a retraction system to fully retract and latch the logging tool in the garage.

28. The method of claim 24, wherein the external force is provided when the logging tool reacts against borehole rugosity.

29. The method of claim 24, wherein the external force is provided when the pipe is downwardly manipulated during lowering or moving the pipe.

* * * * *